US008408452B2

(12) United States Patent
Churvis et al.

(10) Patent No.: US 8,408,452 B2
(45) **Date of Patent: *Apr. 2, 2013**

(54) CONTAINER WITH MODIFIED CORNER

(75) Inventors: Michael A Churvis, Germantown, TN (US); Benjamin W Quaintance, Germantown, TN (US)

(73) Assignee: International Paper Company, Memphis, TN (US)

( * ) Notice: Subject to any disclaimer, the term of this patent is extended or adjusted under 35 U.S.C. 154(b) by 838 days.

This patent is subject to a terminal disclaimer.

(21) Appl. No.: 11/897,527

(22) Filed: Aug. 30, 2007

(65) Prior Publication Data

US 2009/0057382 A1 Mar. 5, 2009

(51) Int. Cl.
*B65D 5/42* (2006.01)
*B65D 5/46* (2006.01)

(52) U.S. Cl. ..... 229/108; 229/117.13; 229/109

(58) Field of Classification Search ..... 229/108, 229/120.26, 185.1, 920, 126, 117.14, 117.17, 229/109, 122.21, 122.24
See application file for complete search history.

(56) References Cited

U.S. PATENT DOCUMENTS 1,892,715 A * 1/1933 Wellman ..... 229/109
1,960,635 A * 5/1934 Kinkenon ..... 229/155
1,974,527 A 9/1934 Bliss
2,295,478 A * 9/1942 Jason, Jr. ..... 426/124
2,819,833 A * 1/1958 Sauer ..... 229/109
3,512,697 A * 5/1970 Robinson ..... 229/109
3,841,476 A 10/1974 Elford
3,921,893 A 11/1975 Randle, Jr.
4,319,710 A 3/1982 Osborne
4,362,265 A * 12/1982 Williams ..... 229/125.19
4,417,686 A 11/1983 Wozniacki
4,765,534 A * 8/1988 Zion et al. ..... 229/109
4,828,929 A 5/1989 Pierson
5,261,594 A * 11/1993 Brown et al. ..... 229/191
5,263,634 A 11/1993 Korine
5,358,173 A * 10/1994 Mertz ..... 229/110
5,361,974 A * 11/1994 Earl et al. ..... 229/122.32
5,752,648 A 5/1998 Quaintance
5,860,590 A 1/1999 Blomfield et al.
6,309,335 B1 10/2001 Holton
6,598,785 B2 7/2003 Quaintance
6,651,873 B2 * 11/2003 Quaintance ..... 229/109
6,749,107 B2 6/2004 Quaintance
8,011,565 B2 9/2011 Churvis et al.

* cited by examiner

*Primary Examiner* — Nathan J Newhouse
*Assistant Examiner* — Christopher Demeree
(74) *Attorney, Agent, or Firm* — Matthew M. Eslami

(57) ABSTRACT

A multi-sided container comprises a bottom wall, a top wall, opposite side walls, opposite end walls, a longitudinal axis and a plurality of diagonal corner walls. At least one of the plurality of diagonal corner walls that is defined by at least one diagonal corner panel and at least one reinforcement flap is overlapping one another. A portion of the bottom wall projects under and beyond a bottom edge of the at least one diagonal corner wall.

13 Claims, 20 Drawing Sheets

CONTAINER WITH MODIFIED CORNER

FIELD OF THE INVENTION

This invention relates generally to packaging, and in particular to a modified Bliss-style shipping container of simplified construction and enhanced stiffness and rigidity.

BACKGROUND OF THE INVENTION

Various styles of shipping containers are known in the prior art, including the so-called Bliss-style container in which a wrapper is folded around and stapled or glued to a pair of end pieces to form an enclosed container. The end pieces normally comprise flat panels that form the end walls in the container, and the wrapper forms the bottom wall, sidewalls and top wall. Flanges on opposite edges of the wrapper are folded and glued or otherwise fastened to the end wall panels to secure the wrapper and end pieces together. The flanges fastened against the end wall panels in the corners of the container serve to strengthen the container in comparison to a typical box that is folded from a single blank and has single panel thickness in the end walls and sidewalls. Compression or stacking strength of the container normally is enhanced by orienting the corrugations of the wrapper so that they extend vertically, but this sometimes results in inefficient utilization of corrugator width during manufacture of the container.

Another common style of shipping container is the so-called Defor™ container made by International Paper Company. The Defor™ container typically is formed from a single blank that is folded to form double thickness end walls and/or sidewalls and therefore normally has greater strength than a Bliss-style container, although it requires more material in its manufacture. Stacking tabs normally project from the upper edges of the end walls or sidewalls and notches in the lower edges receive the stacking tabs when two or more containers are stacked on top of one another. One of the panels forming a part of the end walls or sidewalls can be folded to form a diagonal panel in each corner to lend greater stacking strength to the container. Other examples of prior art are disclosed in Assignee's prior U.S. Pat. Nos. 6,598,785; 5,752,648; 4,417,686.

Some Bliss-style containers have modified corners wherein a diagonal corner panel extends across each corner to increase the stacking strength, but in these conventional modified corner Bliss-style containers there is nothing behind the angled panel except the edge of the wrapper and the wrapper flange that is secured to the end panel. Moreover, these modified corner design of the flanges on the wrapper must be relatively wide to reach past where the diagonal corner panel joins the end panel. This results in weak areas in the bottom of the container at each corner.

SUMMARY OF THE INVENTION

The shipping container of the present invention has features of both the Bliss-style container and the Defor™ container, but has advantages possessed by neither of them. In one embodiment of the invention, the container is formed from three pieces, including a wrapper blank secured onto two end pieces. The end pieces are uniquely constructed so that a double wall lamination is created in each end wall and partial side panels are used in each sidewall of the assembled container, allowing very high compression levels to be achieved from the use of relatively lightweight materials. The design of the container in the present invention enables the corrugations in the wrapper blank to be oriented horizontally since compression strength is obtained primarily from the end structures, allowing efficient and optimized utilization of corrugator width during manufacture of the container.

Accordingly, one aspect of the present invention relates a multi-sided container comprises a bottom wall, a top wall, opposite side walls, opposite end walls, a longitudinal axis and a plurality of diagonal corner walls. At least one of the plurality of diagonal corner walls that is defined by at least one diagonal corner panel and at least one reinforcement flap is overlapping one another. A portion of the bottom wall projects under and beyond a bottom edge of the at least one diagonal corner wall.

Another aspect of the present invention relates to a multi-sided container comprising a bottom wall, side walls, and top walls all cooperate with one another to form a wrapper. At least one end wall, one diagonal corner panel, and a partial side wall panel all cooperate with one another to form one end piece wherein the one end piece and the wrapper are attached to one another to form a multi-sided container. At least one diagonal corner panel and at least one reinforcement flap are overlapping one another. A portion of the bottom wall projects under and beyond a bottom edge of the at least one diagonal corner wall.

One further aspect of the present invention relates to a blank for making a multi-sided container having a bottom wall, a top wall, opposite side walls, opposite end walls, a longitudinal axis and a plurality of diagonal corner walls. The blank comprises a wrapper having a bottom panel and two pairs of side panels longitudinally attached to the bottom panel. A pair of end pieces is configured to be transversely attached to the wrapper to form a multi-sided container wherein when the multi-sided container is constructed, a portion of the bottom wall projects under and beyond a bottom edge of the at least one diagonal corner wall.

Yet another aspect of the present invention relates to a blank for making a multi-sided container having a bottom wall, a top wall, opposite side walls, opposite end walls, a longitudinal axis and a plurality of diagonal corner walls. The blank comprises a unitary piece of generally rectangularly shaped material having a plurality of first, approximately parallel, spaced apart fold lines delimiting a bottom panel, side wall panels, and top wall panels. A plurality of approximately parallel spaced apart second fold lines are extending perpendicular to the first fold lines and defining a transversal edge of the bottom panel, side wall panels, and top wall panels. A plurality of flap panels are joined to the transversal edges of the side wall panels and top wall panels. Two end pieces are configured to be attached at least to the respective transversal edges of the bottom panel, each of the end pieces having a plurality of third, parallel, spaced apart fold lines delimiting end wall panels, diagonal corner panels, and partial side wall panels.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DESCRIPTION OF THE INVENTION

Figure 1:
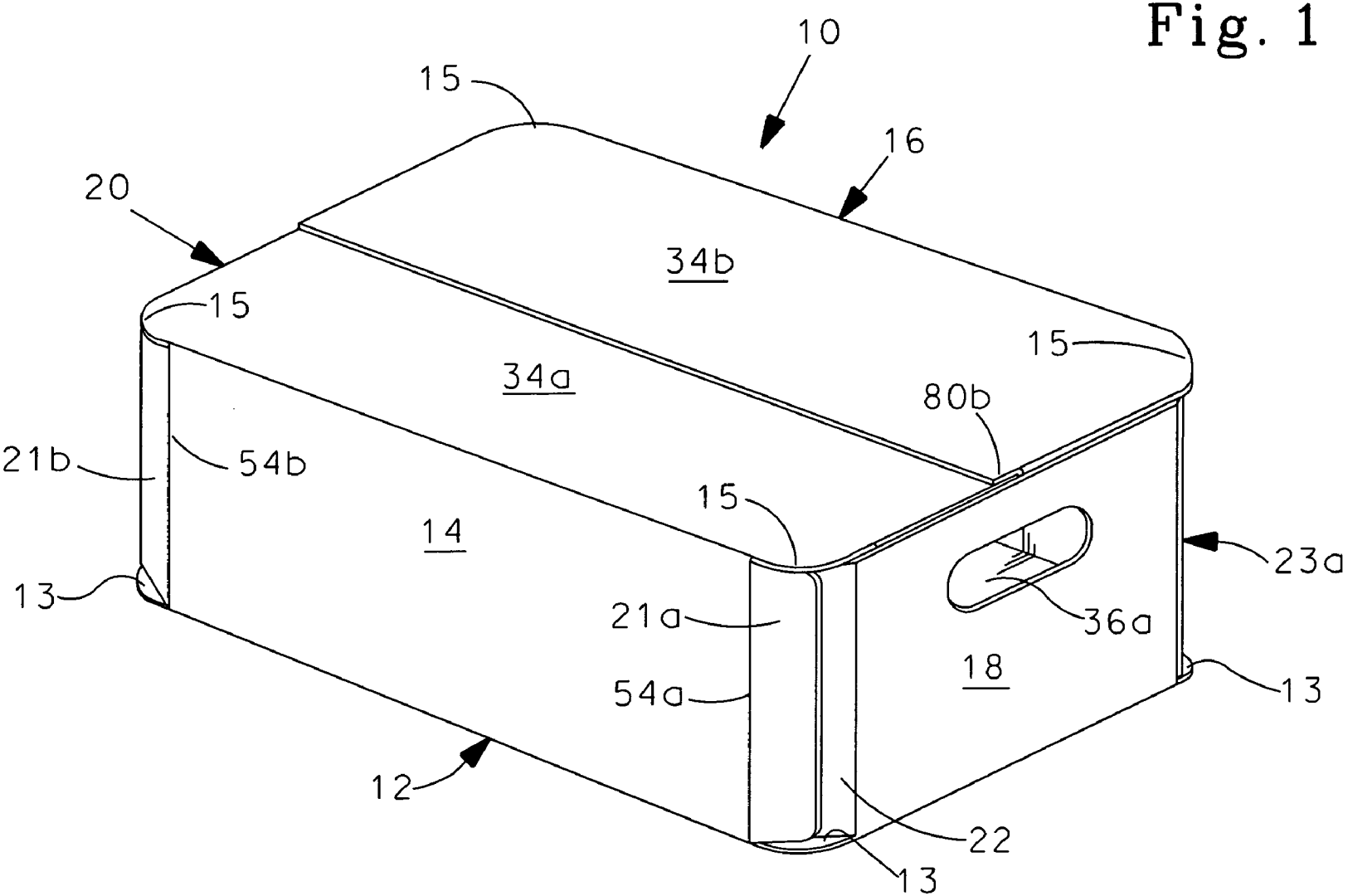
FIG. 1 is a top perspective view of a container in accordance with a first embodiment of the invention.

FIG. 1 is a top perspective view of a container 10 in accordance with a first embodiment of the invention. The container 10 comprises a bottom wall 12, opposite parallel side walls 14, 16, opposite parallel end walls 18, 20 and diagonal corner panels 22, 24, 26 and 28 (FIG. 3) connecting the respective side walls 14, 16 and respective end walls 18, 20 at adjacent ends. The bottom 12' has an advantage of having four identical rounded corners 13' which enhances the integrity of the container 10 as will be described in greater detail hereinafter. The diagonal corner walls 22, 24, 26 and 28 extend at an angle generally ranges from about 33 to 38 degrees with respect to the longitudinal axis of the container 10. As one of ordinary skill in the art would appreciate, it is within the scope of the present invention to use other angles such as 45° to meet the requirement of the intended design of the container 10. Each of the side walls 14, 16 includes a respective pair of flaps 21*a*, 21*b* and 23*a*, 23*b* that are defined by respective fold lines 54*a*, 54*b*, 56*a*, 56*b*. The opposite width of the respective side walls 14 and 16 is such that the flaps 21*a*, 21*b* and 23*a*, 23*b* project at their opposite side edges over the diagonal corner walls 22, 24, 26 and 28, terminating the flaps at their edges proximately in the middle of the respective diagonal corner walls 22, 24, 26 and 28. Two top wall panels 34*a*, 34*b* generally defined a top wall that encloses the container 10. The top wall panel 34*a* is integrally attached to the side wall 14 and the top wall panel 34*b* is integrally attached to the side wall 16, but one of ordinary skill in the art would appreciate that it is within the scope of the present invention to use a single cover integrally attached to one of the side walls or end walls of the container. Alternatively, the top wall panels 34*a*, 34*b* may detachably cover the container 10. Two hand hole openings 36*a*, 36*b* (FIG. 3) are formed on the respective end walls 18, 20 to facilitate handling of the container 10.

Figure 2:
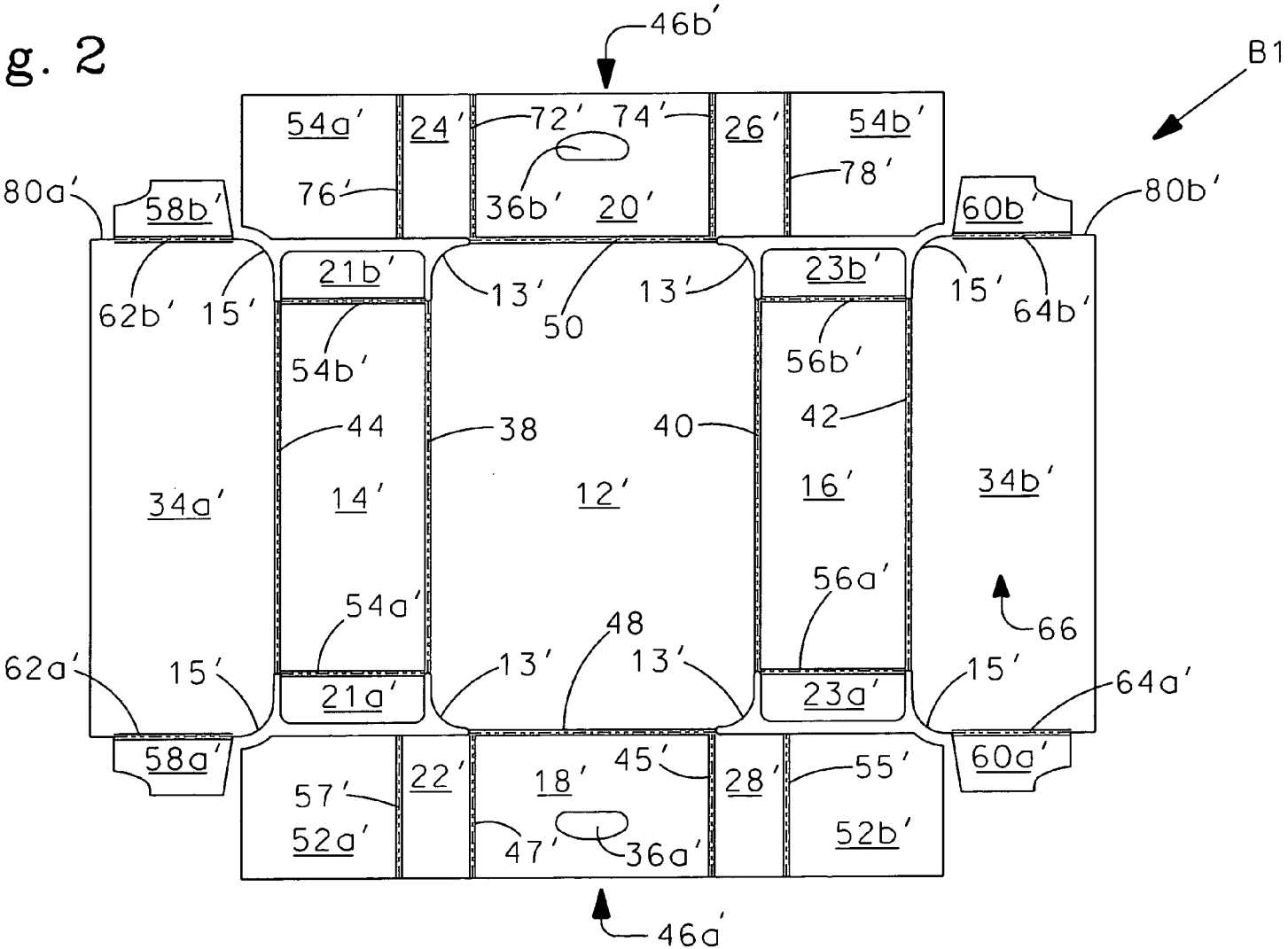
FIG. 2 is a plan view of a unitary blank B1 used to form the container shown in FIG. 1 in accordance with a first embodiment of the invention.

FIG. 2 is a plan view of a unitary blank B1 used to form the container 10 shown in FIG. 1 in accordance with a first embodiment of the invention. The blank B1 comprises a centrally located rectangular panel 12' that forms the bottom wall 12. The rectangular panel 12' has an advantage of having four identical rounded corners 13' which enhances the integrity of the container 10 when the blank B1 is formed into container 10. Side wall forming panels 14' and 16' are foldably joined to opposite side edges of the panel 12' by respective fold lines 38, 40. Each of the side wall panels 14', 16' includes two respective identical flaps 21*a*', 21*b*' and 23*a*', 23*b*' defined by respective fold lines 54*a*', 54*b*', and 56*a*', 56*b*'. Top wall panels 34*a*' and 34*b*' are foldably joined to respective longitudinal edges of the sidewall panels 14' and 16', opposite of their folded connection to the panel 12', by fold lines 42, 44. Each of the top wall panels 34*a*', 34*b*' includes two respective identical flaps 58*a*', 58*b*' and 60*a*', 60*b*' defined by respective fold lines 62*a*', 62*b*', and 64*a*', 64*b*'. An Arrow mark 66 indicates the direction of corrugation of the blank B1. Similarly, each of the top wall panels 34*a*', 34*b*', as noted with respect to the rectangular panel 12', has an advantage of having two identical rounded corners 15' which enhances the integrity of the container 10 when the blank B1 is formed into container 10. In addition, it should be noted that flaps 58*a*', 58*b*' and 60*a*', 60*b*' do not extend the full width of the top wall panels 34*a*', 34*b*', but terminate short of the outer free edge thereof, defining projecting tabs 80*a*' and 80*b*'. A pair of end pieces 46*a*, 46*b* is foldably joined to respective transverse edges of the panel 12' by fold lines 48, 50. The end pieces 46*a*, 46*b* are essentially identical to one another and they are mirror images of one another. The end piece 46*a* includes an end wall panel 18', two relatively reinforcing corner panels 22' and 28' foldably joined to opposite ends of the panel 18' by fold lines 45', 47', and second partial sidewall panels 52*a*', 52*b*' are foldably joined to outer edges of respective narrow reinforcing corner panels 22', 28' by fold lines 55' and 57'. Similarly, The end piece 46*b* includes an end wall panel 20', two relatively reinforcing corner panels 24' and 26' foldably joined to opposite ends of the panel 20' by fold lines 72', 74', and second partial sidewall panels 54*a*', 54*b*' are foldably joined to outer edges of respective corner panels 24', 26' by fold lines 76' and 78'. Openings 36*a*', 36*b*' are formed on the respective end wall panels 18', 20' so that when the blank B1 is folded, these openings 36*a*', 36*b*' forms the hand hole openings 36*a*, 36*b* in the container 10 as described with reference to FIG. 1.

Figure 3:
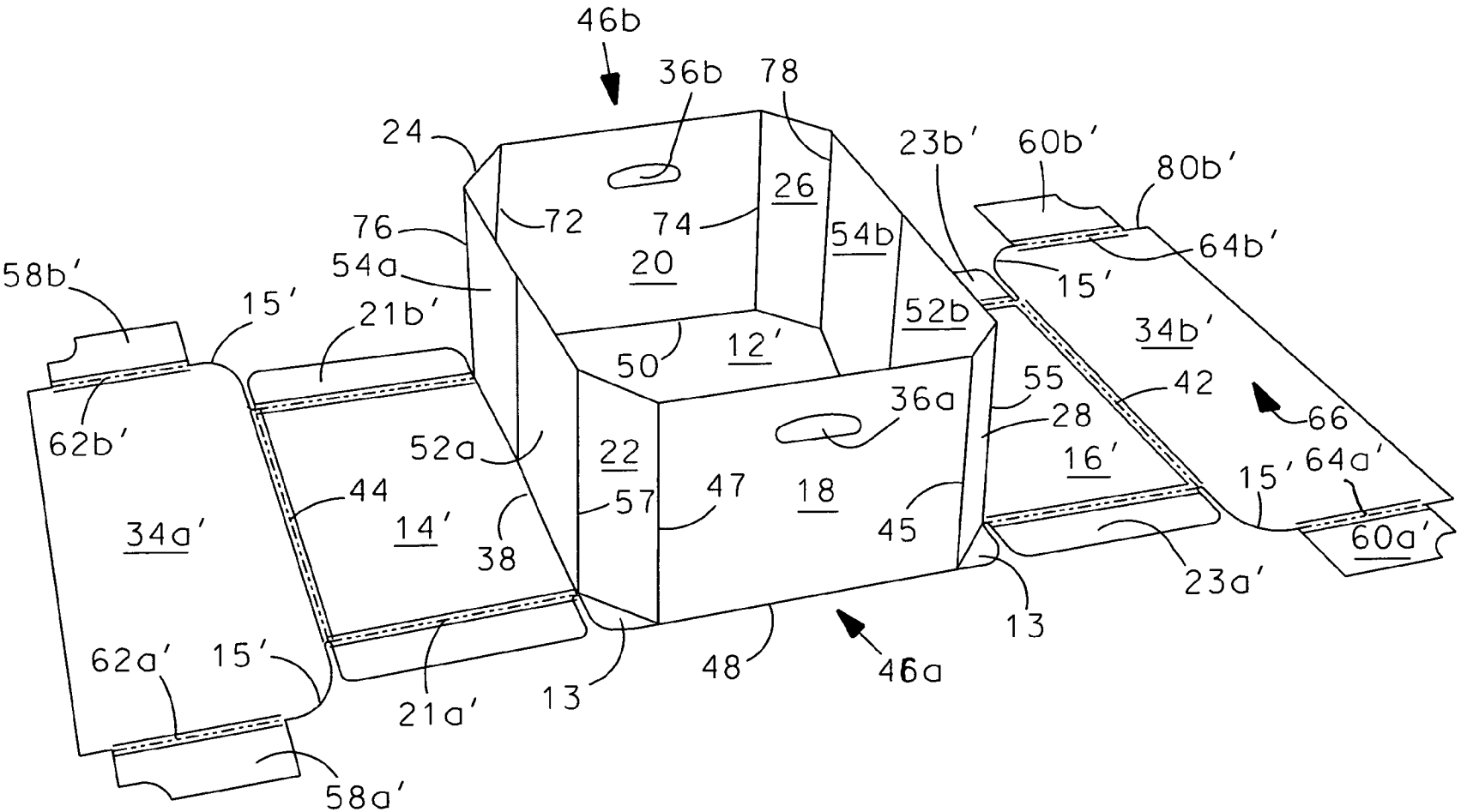
FIG. 3 is similar to FIG. 2, showing the unitary blank in a partially folded position by illustrating a portion of the unitary blank formed into the end walls of the container depicted in FIG. 1.

FIG. 3 is similar to FIG. 2, showing the unitary blank B1 in a partially folded position by illustrating a portion of the unitary blank B1 formed into the end walls 18, 20 of the container 10 depicted in FIG. 1. Each of the end pieces 46*a*' and 46*b*' is folded 90 degrees with respect to their fold lines 48 and 50. Then, the respective relatively diagonal corner panels 22', 24' and 26', 28' are folded inwardly toward the bottom panel 12' to form the diagonal corner panels 22', 24' and 26', 28' at an angle generally 38 degrees with respect to the longitudinal axis of the container 10 so that each of the rounded corners 13 provides a greater base by increasing surface area for the diagonal corner panels 22', 24' and 26', 28' to transmit pressure applied at the contact area of the diagonal corner panels and the bottom wall. Then, partial sidewall panels 52*a*', 52*b*', 54*a*', 54*b*' are folded with respect to fold lines 55', 57', 76', and 78' in a manner such that the bottom edges of the partial sidewall panels 52*a*', 52*b*', 54*a*', 54*b*' are respectively coincided with the fold line 38 and 40.

Figure 4:
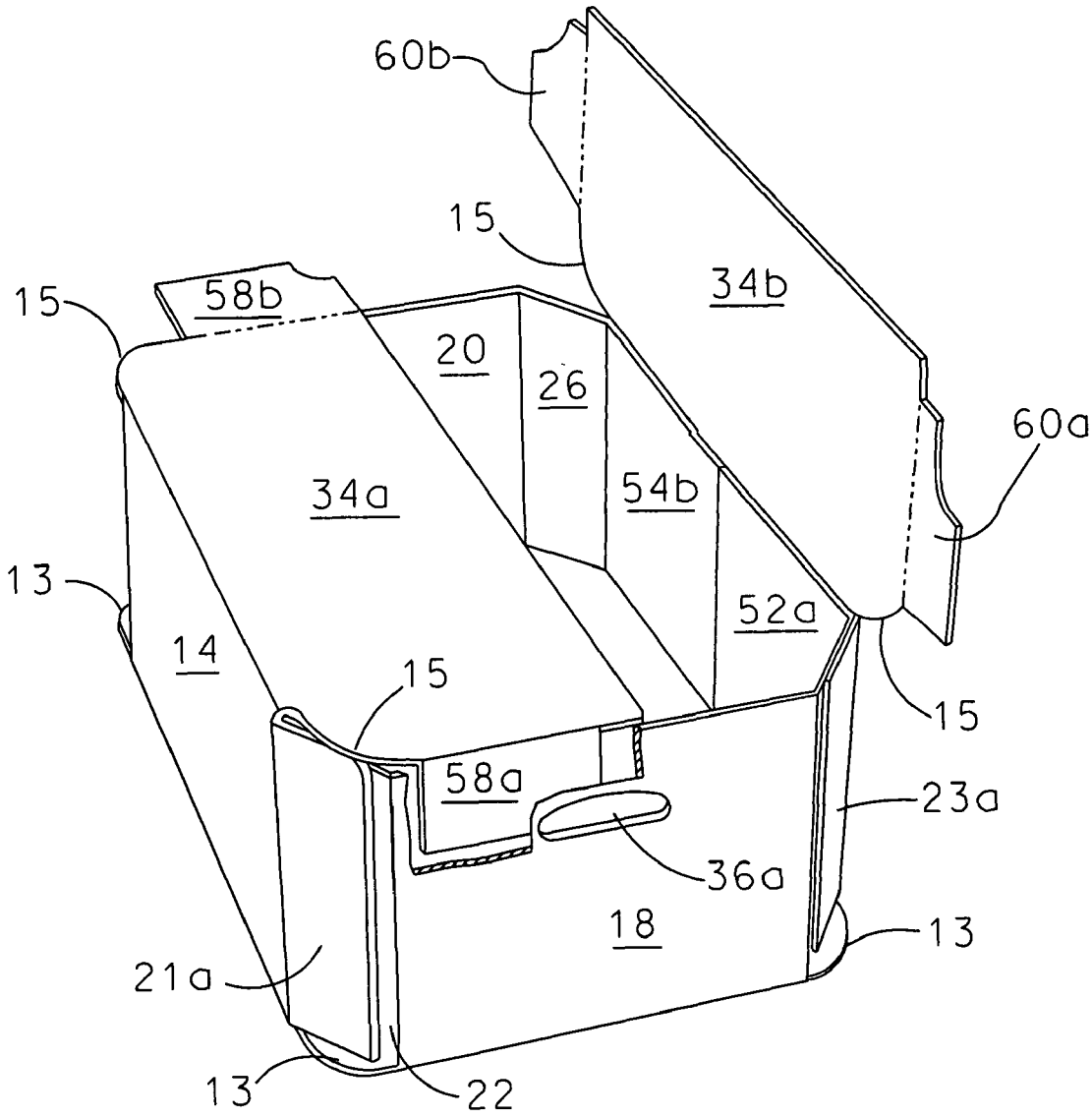
FIG. 4 is a perspective view of the fully constructed container formed from the unitary blank shown in FIG. 2 and illustrating the container in FIG. 1 in a partially open position.

FIG. 4 is a perspective view of the fully constructed container 10 formed from the blank shown in FIG. 2 and illustrating the container 10 in FIG. 1 in a partially opened position. The respective side wall forming panels 14' and 16' are folded at 90 degrees with respect to the panel 12' along the fold lines 38, 40 and configured to be attached with the respective partial sidewall panels 52*a*, 52*b* and 54*a*, 54*b* so that the respective side wall forming panels 14' and 16' and the respective partial sidewall panel 52*a*, 52*b* and 54*a*, 54*b* are glued to one another. Next, the respective top wall panels 34*a*', 34*b*' are folded along respective fold lines 42, 44 to form top wall 34*a*, 34*b* as depicted in FIG. 4. The respective flaps 58*a*, 58*b*, 60*a*, 60*b* are folded along the respective fold lines 62'*a*, 62*b*', 64*a*', 64*b*' and tucked inside the container 10.

Figure 5:
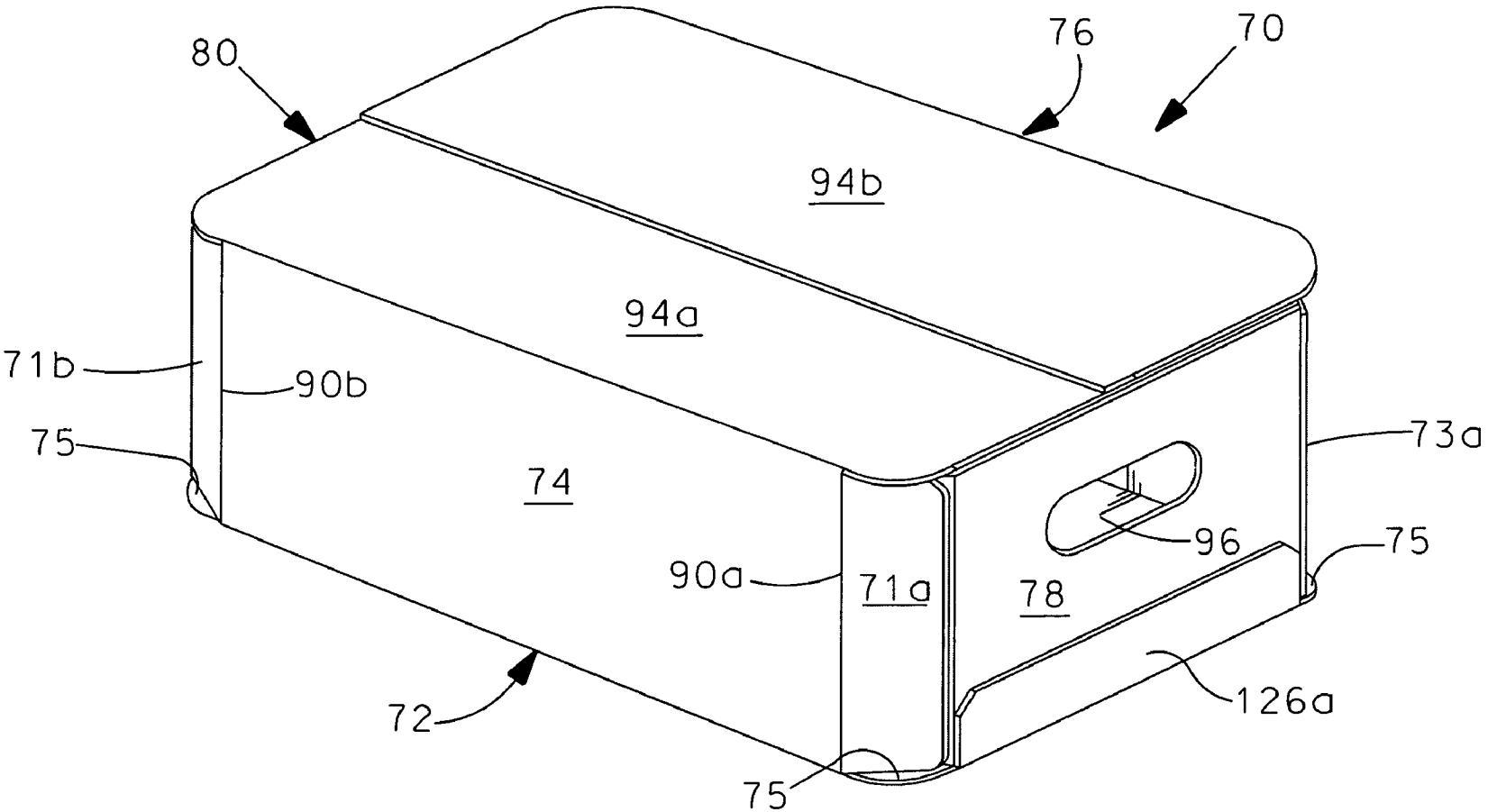
FIG. 5 is a top perspective view of a three pieces container in accordance with a second embodiment of the invention.

FIG. 5 is a top perspective view of a container 70 in accordance with a second embodiment of the invention. The container 70 comprises a bottom wall 72, opposite parallel side walls 74, 76, opposite parallel end walls 78, 80 and diagonal corner panels 82, 84, 86 and 88 (FIG. 8) connecting the respective side walls 74, 76 and respective end walls 78, 80 at adjacent ends. The diagonal corner walls 82, 84, 86 and 88 extend at an angle generally ranges from about 33 to 38 degrees with respect to the longitudinal axis of the container 70. Each of the side walls 74, 76 includes a respective pair of flaps 71*a*, 71*b* and 73*a*, 73*b* that are defined by respective fold lines 90*a*, 90*b*, 92*a*, 92*b*. The opposite width of the respective side walls 74 and 76 is such that they project at their opposite side edges 71*a*, 71*b* over the entire surface of the diagonal corner walls 82, 84, 86 and 88, terminating their edges at the respective edges of the diagonal corner walls 82, 84, 86 and 88. Two top walls 94*a*, 94*b* are generally defined as top wall that encloses the container 70. The top wall 94*a* is integrally attached to the side wall 74 and the top wall 94*b* is integrally attached to the side wall 76, but one ordinary skill in the art would appreciate that it is within the scope of the present invention to use a single cover integrally attached to one of the side walls 74, 76 or end walls 78, 80 of the container 70. Alternatively, the top walls 94*a*, 94*b* may detachably cover the container 70. Two hand hole openings 96*a*, 96*b* are formed on the respective end walls 78, 80 to facilitate handling of the container 70.

Figure 6:
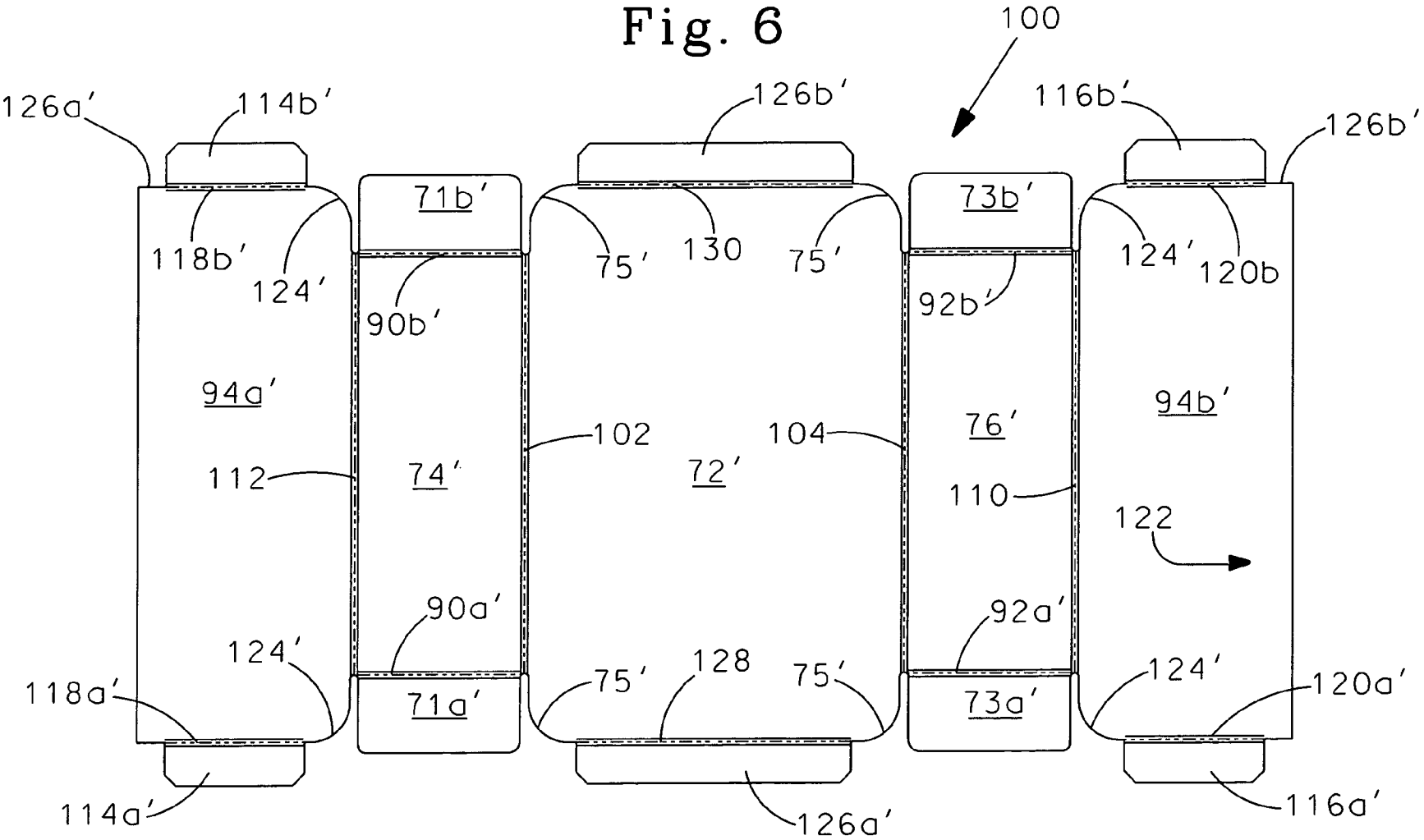
FIG. 6 is a plan view of a wrapper blank that forms the bottom wall, top and side walls of the three-piece container depicted in FIG. 1.

FIG. 6 is a plan view of a wrapper blank 100 that forms the bottom wall panel 72, top walls 94*a*, 94*b* and side walls 74*a*, 76*b* of the three-piece container 70 depicted in FIG. 5 in accordance with the second embodiment of the invention. The wrapper blank 100 comprises a centrally located rectangular panel 72' that forms the bottom wall 72. The rectangular panel 72' has an advantage of having four identical rounded corners 75' which enhances the integrity of the container 70 when the wrapper blank 100 is folded. Side wall forming panels 74' and 76' are foldably joined to opposite side edges of the panel 72' by respective fold lines 102, 104. Each of the side wall panels 74', 76' includes two respective identical flaps 71*a*', 71*b*' and 73*a*', 73*b*' defined by respective fold lines 90*a*', 90*b*', and 92*a*', 92*b*'. Top wall panels 94*a*' and 94*b*' are foldably joined to respective longitudinal edges of the sidewall panels 74' and 76', opposite of their folded connection to the panel 72', by fold lines 110, 112. Each of the top wall panels 94*a*', 94*b*' includes two respective identical flaps 114*a*', 114*b*' and 116*a*', 116*b*' defined by respective fold lines 118*a*', 118*b*', and 120*a*', 120*b*'. An Arrow mark 122 indicates the direction of corrugation of the wrapper blank 100. Similarly, each of the top wall panels 94*a*', 94*b*', as noted with respect to the rectangular panel 72', has an advantage of having two identical rounded corners 124' which enhances the integrity of the container 70 when the wrapper blank 100 is folded. In addition, it should be noted that flaps 114*a*', 114*b*' and 116*a*', 116*b*' do not extend the full width of the top wall panels 94*a*', 94*b*', but terminate short of the outer free edge thereof, defining projecting tabs 126*a*' and 126*b*'. A pair of flaps 126*a*', 126*b*' is foldably joined to respective transverse edges of the panel 72' by fold lines 128, 130. The flaps 126*a*', 126*b*' are essentially identical to one another and they are mirror images of one another. The respective flaps 126*a*', 126*b*' are glued to the respective end walls 78, 80 when the wrapper blank 100 is folded to form the bottom wall 72, side walls 74, 76, and top walls 94*a* and 94*b*.

Figure 7:
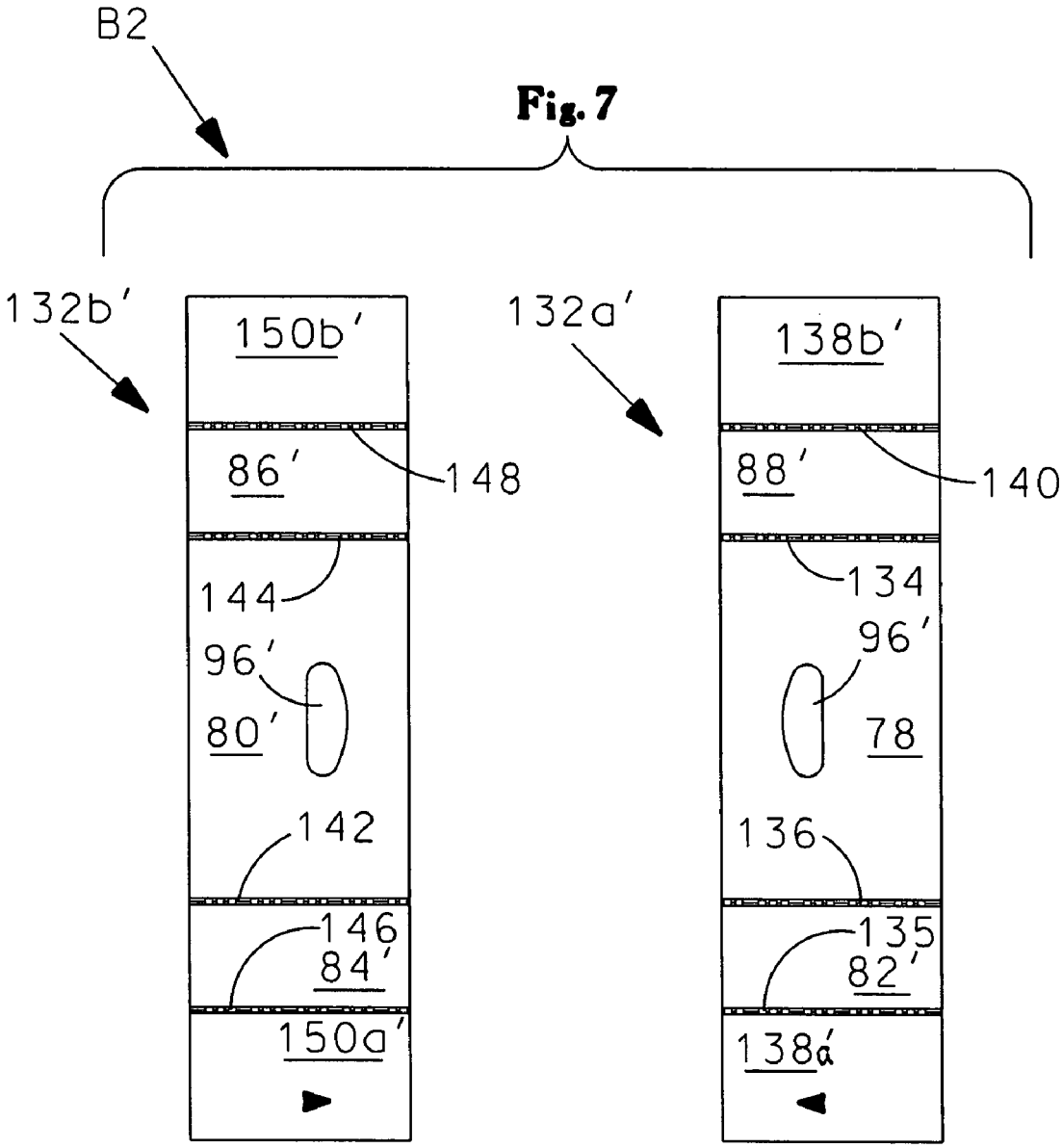
FIG. 7 is a plan view of a pair of blanks B2 that form the end pieces used to construct the three-piece container depicted in FIG. 5.

FIG. 7 is a plan view of a pair of blanks B2, blank 132*a*' and blank 132*b*' each form the end walls 78 and 80 used to construct the three-piece container 70 depicted in FIG. 5. The pair of end pieces 132*a*' and 132*b*' is attached to respective transverse edges of the panel 72'. The end pieces 132*a*' and 132*b*' are essentially identical to one another and they are mirror images of one another. The end piece 132*a*' includes an end wall panel 78', two relatively narrow reinforcing corner panels 82' and 88' foldably joined to opposite ends of the panel 78' by fold lines 134, 136, and second partial sidewall panels 138*a*', 138*b*' are foldably joined to outer edges of respective narrow reinforcing corner panels 82' and 88' by fold lines 135 and 140. Similarly, The end piece 132*b*' includes an end wall panel 80', two relatively narrow reinforcing corner panels 84' and 86' foldably joined to opposite ends of the panel 80' by fold lines 142, 144, and second partial sidewall panels 150*a*', 150*b*' are foldably joined to outer edges of respective narrow reinforcing corner panels 84' and 86' by fold lines 146 and 148. Openings 96*a*', 96*b*' are formed on the respective end wall panels 78', 80' so that when the end pieces 132*a*', 132*b*' are folded, these openings 96*a*', 96*b*' forms the hand hole openings 96*a*, 96*b* in the container 70 as described with reference to FIG. 5.

Figure 8:
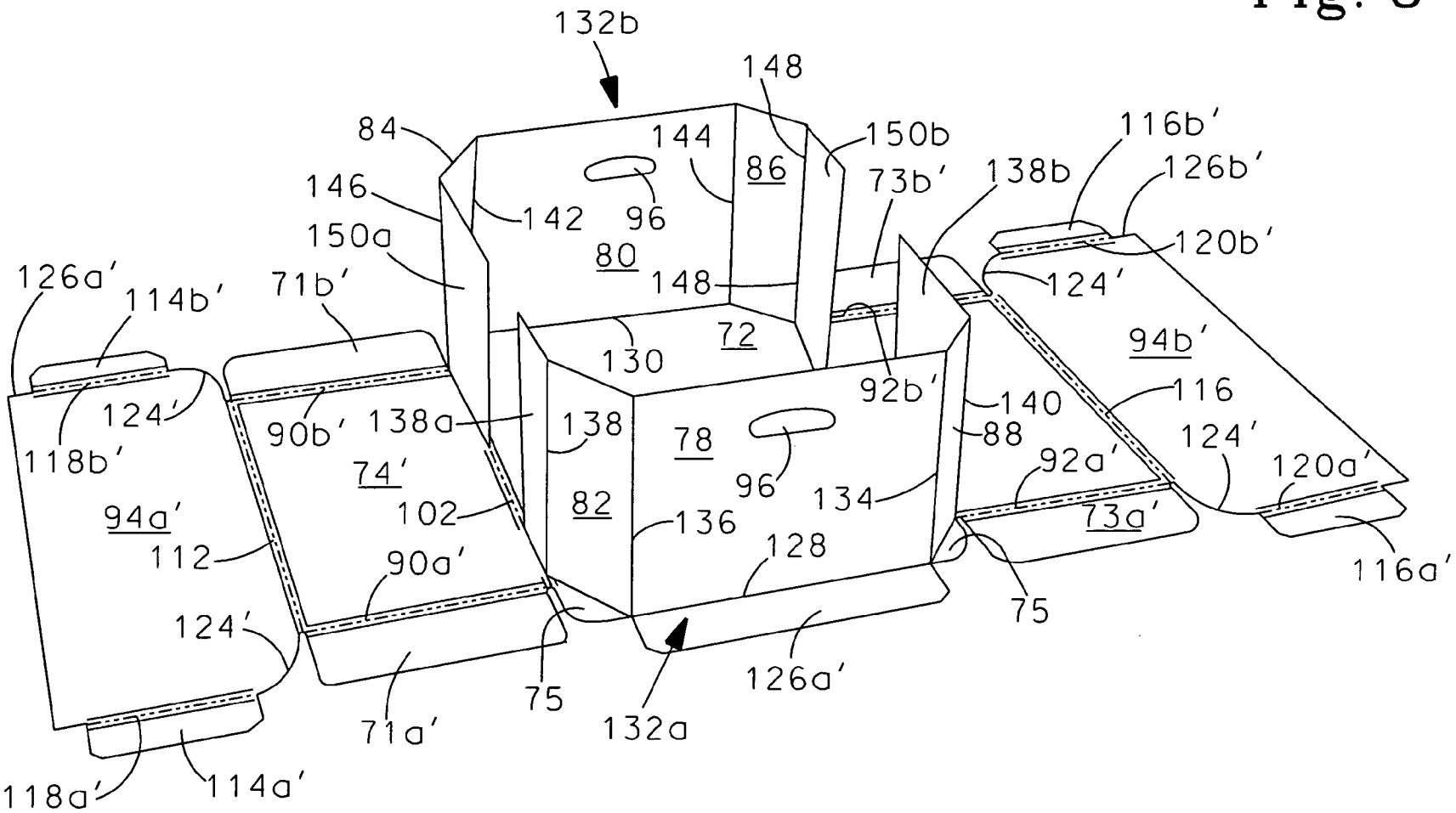
FIG. 8 is a top perspective view of the end pieces located in their operative positions on the wrapper blank shown in FIG. 6, and illustrating the wrapper blank in the folding position around the end pieces.

FIG. 8 is a top perspective view of the end pieces 132*a*, 132*b* located in their operative positions on the wrapper blank 100 shown in FIG. 6 and illustrating the wrapper blank 100 in the folding position around the end walls pieces 132*a*, 132*b*. The end pieces 132*a*, 132*b* are folded along their respective fold lines 134, 136, 142, and 144. The respective relatively narrow reinforcing corner panels 82', 84' and 86', 88' are folded inwardly toward the bottom panel 72' at approximately 45 degrees so that the rounded corners 75 provides a greater base by increasing surface area for the reinforcing corner panels 82', 84' and 86', 88' to transmit pressure applied at those location. Then, partial sidewall panels 138*a*', 138*b*', 150*a*', 150*b*' are folded with respect to fold lines 138, 140, 146, and 148 in a manner such that the bottom edges of the partial sidewall panels 138a', 138b', 150a', 150b' are respectively coincided with the fold line 102 and 104.

Figure 9:
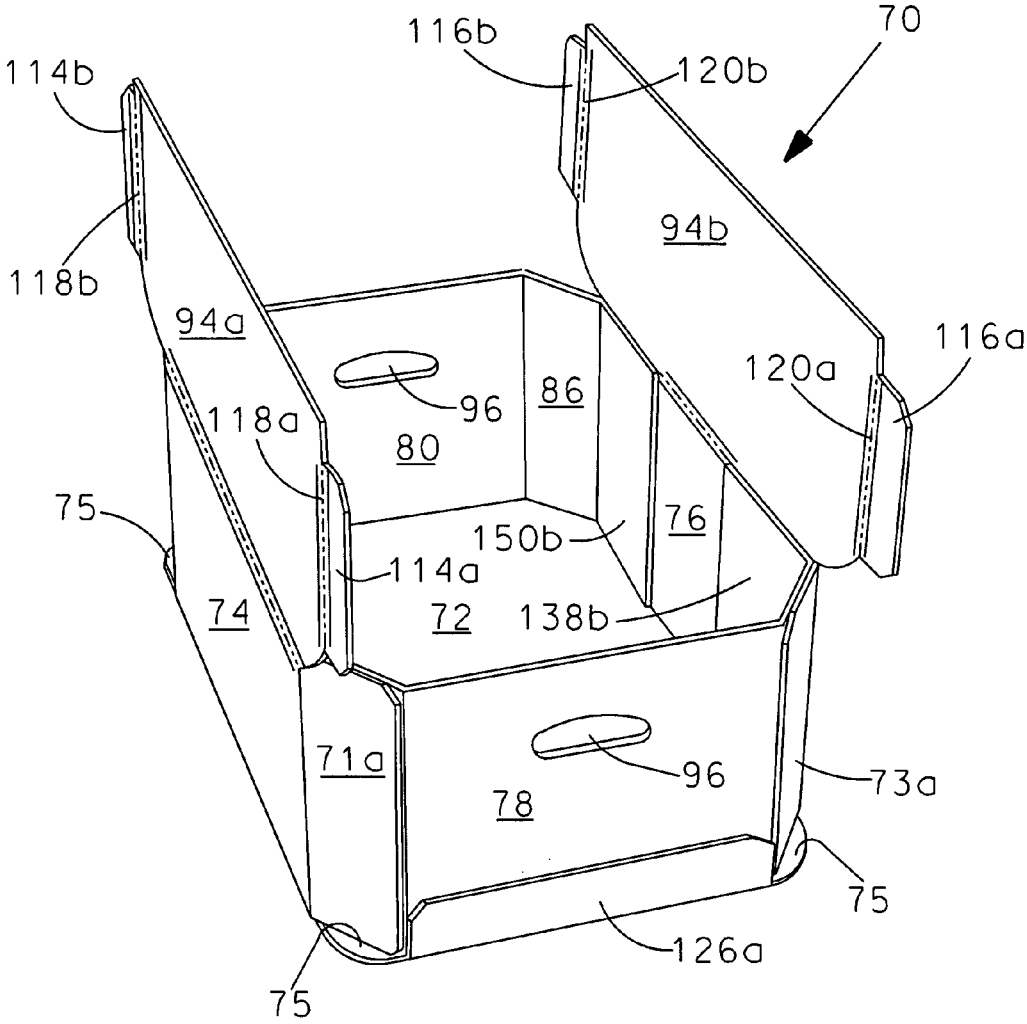
FIG. 9 is a perspective view of the fully constructed three-piece container depicted in FIG. 5 showing the wrapper blank folded and glued against the end pieces to form the bottom wall and side walls of the container.

FIG. 9 is a perspective view of the fully constructed three-piece container 70 depicted in FIG. 5 showing the wrapper blank 100 folded and glued against the end pieces 132a, 132b to form the bottom wall 72 and side walls 74, 76 of the container 70. The respective side wall forming panels 74 and 76 are folded at 90 degrees with respect to the panel 72' along the fold lines 102, 104 and configured to be attached with the respective partial sidewall panels 52a, 52b and 54a, 54b so that the respective side wall forming panels 14' and 16' and the respective partial sidewall 138a, 138b and 150a, 150b are glued to one another. Next, the respective top wall panels 94a', 94b' are folded along respective fold lines 112, 110 to form top wall 94a, 94b as depicted in FIG. 4. The respective flaps 114a, 114b, 116a, 116b are folded along the respective fold lines 118a, 118b, 120a, 120b and tucked inside the container 70. Then the flaps 126a, 126b are glued to the respective end walls 78, 80.

Figure 10:
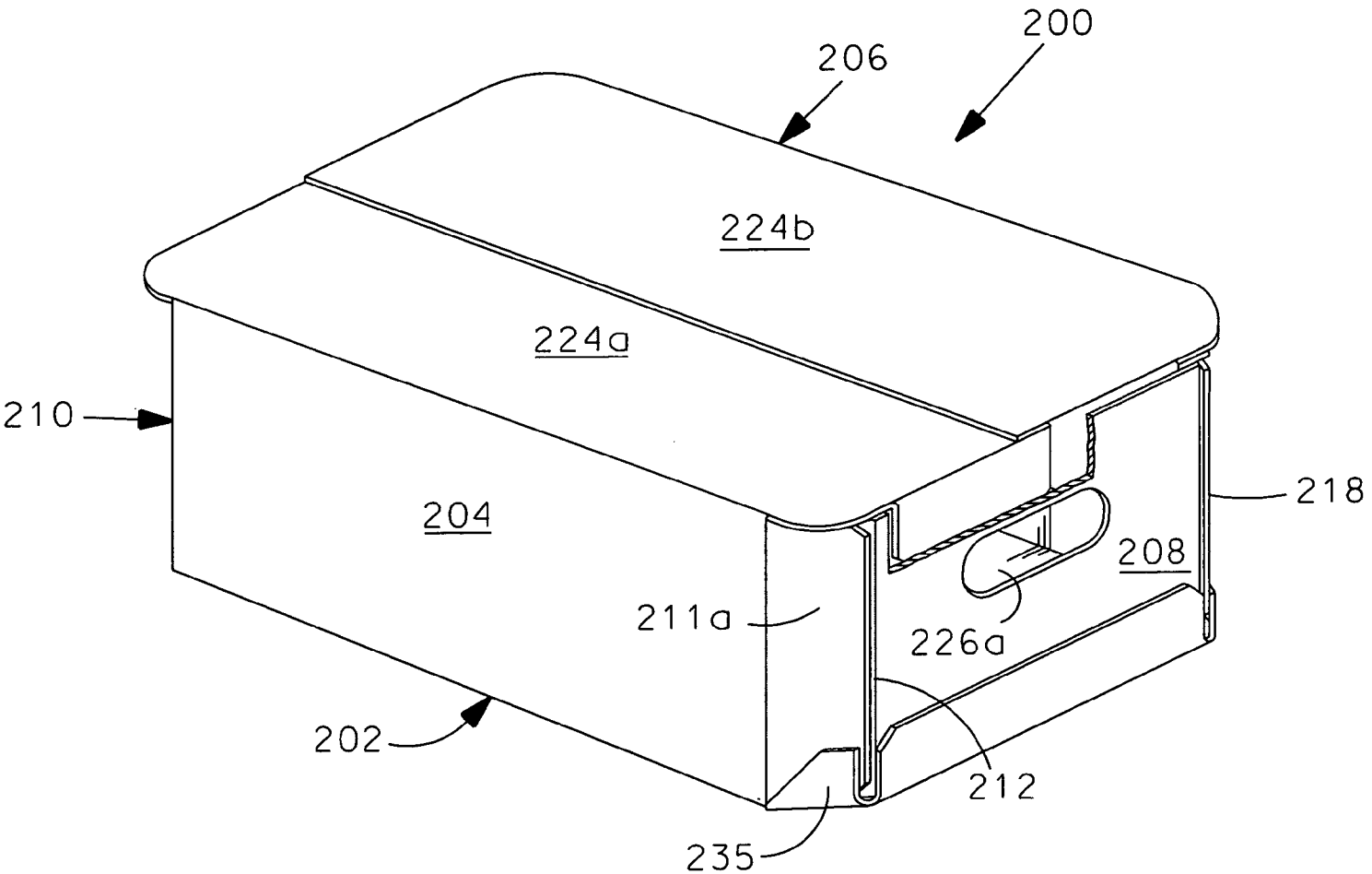
FIG. 10 is a top perspective view of a three piece container in accordance with a third embodiment of the invention.

FIG. 10 is a top perspective view of a container 200 in accordance with a third embodiment of the invention. The container 200 comprises a bottom wall 202, opposite parallel side walls 204, 206, opposite parallel end walls 208, 210 and diagonal corner panels 212, 214, 216 and 218 (FIG. 13) connecting the respective side walls 204, 206 and respective end walls 208, 210 at adjacent ends. The diagonal corner walls 212, 214, 216 and 218 extend at an angle generally 38 degrees with respect to the longitudinal axis of the container 200. Each of the side walls 204, 206 includes a respective pair of flaps 211a, 211b and 213a, 213b that are defined by respective fold lines 220a, 220b, 222a, 222b. The opposite width of the respective side walls 204 and 206 is such that they project at their opposite side edges 211a, 211b over the entire surface of the diagonal corner walls 212, 214, 216 and 218, terminating their edges at the respective edges of the diagonal corner walls 212, 214, 216 and 218. Two top walls 224a, 224b are generally defined as the top wall that encloses the container 200. The top wall 224a is integrally attached to the side wall 204 and the top wall 224b is integrally attached to the side wall 206, but one ordinary skill in the art would appreciate that it is within the scope of the present invention to use a single cover integrally attached to one of the side walls 204, 206 or end walls 208, 210 of the container 200. Alternatively, the top walls 224a, 224b may detachably cover the container 200. Two hand hole openings 226 are formed on the respective end walls 208, 210 to facilitate handling of the container 200.

Figure 11:
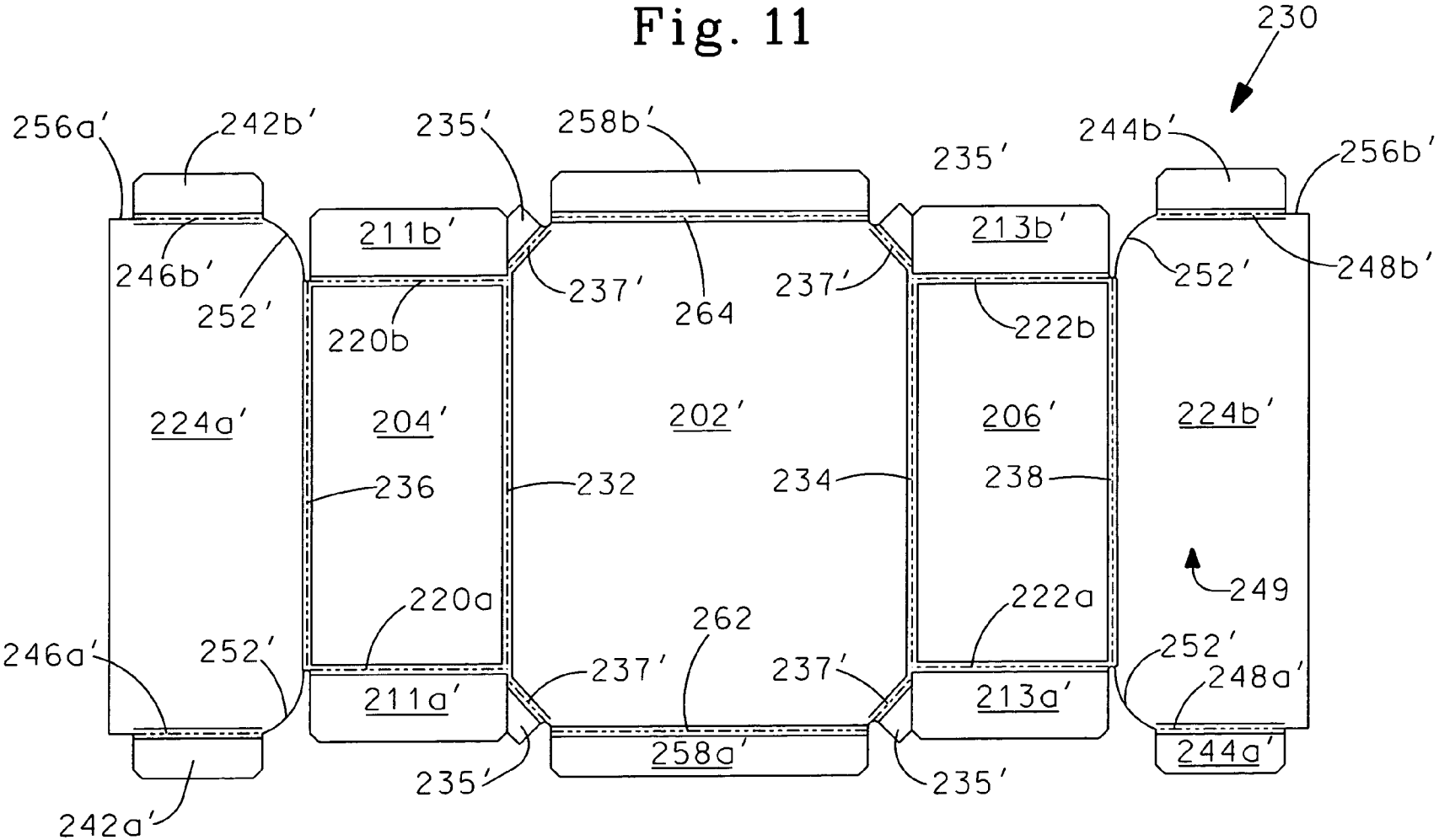
FIG. 11 is a plan view of a wrapper blank that forms the bottom wall, top and side walls of the three-piece container depicted in FIG. 10.

FIG. 11 is a plan view of a wrapper blank 230 that forms the bottom wall 202, top walls 224a, 224b and side walls 204a', 206b', of the three-piece container 200 depicted in FIG. 10 in accordance with the third embodiment of the invention. The wrapper blank 230 comprises a centrally located rectangular panel 202' that forms the bottom wall 202. The rectangular panel 202' has an advantage of having four identical rounded corners 235' which enhances the integrity of the container 200 when the wrapper blank 230 is folded. Side wall forming panels 204' and 206' are foldably joined to opposite side edges of the panel 202' by respective fold lines 232, 234. Each of the side wall panels 204', 206' includes two respective identical flaps 211a', 211b' and 213a', 213b' defined by respective fold lines 220a', 220b', and 222a', 222b'. Top wall panels 224a' and 224b' are foldably joined to respective longitudinal edges of the sidewall panels 204' and 206', opposite of their folded connection to the panel 202', by fold lines 236, 238. Each of the top wall panels 224a', 224b' includes two respective identical flaps 242a', 242b' and 244a', 244b' defined by respective fold lines 246a', 246b', and 248a', 248b'. An Arrow mark 249 indicates the direction of corrugation of the wrapper blank 100. Similarly, each of the top wall panels 224a', 224b' has an advantage of having two identical rounded corners 252' which enhances the integrity of the container 200 when the wrapper blank 230 is folded. In addition, it should be noted that flaps 242a', 242b' and 244a', 244b' do not extend the full width of the top wall panels 224a', 224b', but terminate short of the outer free edge thereof, defining projecting tabs 256a' and 256b'. A pair of flaps 258a', 258b' is foldably joined to respective transverse edges of the panel 202' by fold lines 262, 264. The flaps 258a', 258b' are essentially identical to one another and they are mirror images of one another. The respective flaps 258a', 258b' are glued to the respective end walls 208, 210 when the wrapper blank 230 is folded to form the bottom wall 202, side walls 204, 206, and top walls 224a and 224b.

Figure 12:
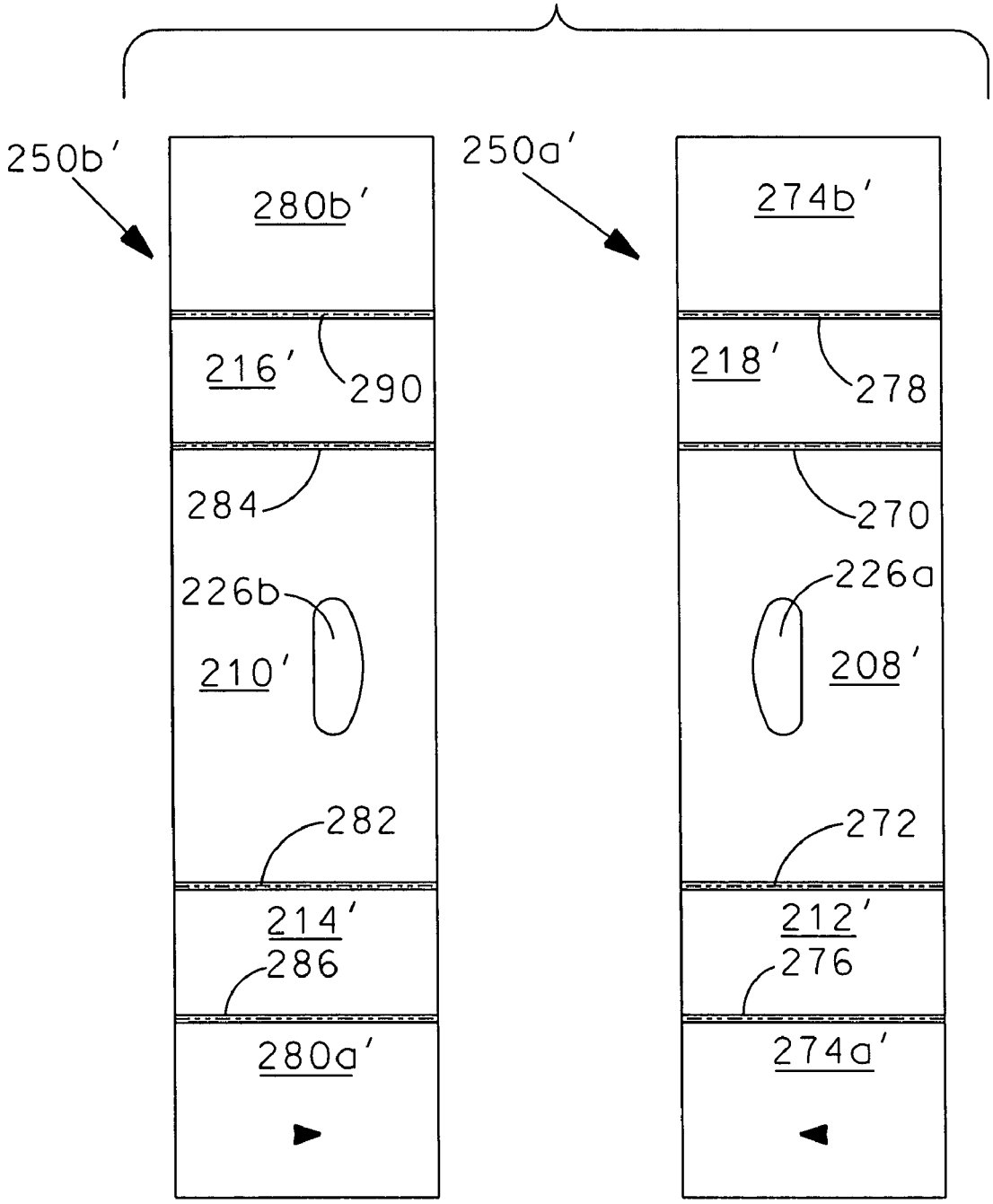
FIG. 12 is a plan view of a pair of blanks that form the end pieces used to construct the three-piece container depicted in FIG. 10.

FIG. 12 is a plan view of a pair of end pieces 250a', 250b' that forms the end walls 208, 210 used to construct the three-piece container 200 as depicted in FIG. 10. The pair of end pieces 250a', 250b' is attached to respective transverse edges of the panel 202'. The end pieces 250a', 250b' are essentially identical to one another and they are mirror images of one another. The end piece 250a' includes an end wall panel 208', two relatively narrow reinforcing corner panels 212' and 218' foldably joined to opposite ends of the panel 208' by fold lines 270, 272, and second partial sidewall panels 274a', 274b' are foldably joined to outer edges of respective narrow reinforcing corner panels 212' and 218' by fold lines 276 and 278. Similarly, The end piece 250b' includes an end wall panel 210', two relatively narrow reinforcing corner panels 214' and 216' foldably joined to opposite ends of the panel 210' by fold lines 282, 284, and second partial sidewall panels 280a', 280b' are foldably joined to outer edges of respective narrow reinforcing corner panels 214' and 216' by fold lines 286 and 290. Openings 226a', 226b' are formed on the respective end wall panels 208', 210' so that when the end pieces 250a', 250b' are folded, these openings 226a', 226b' forms the hand hole openings 226a, 226b in the container 200 as described with reference to FIG. 10.

Figure 13:
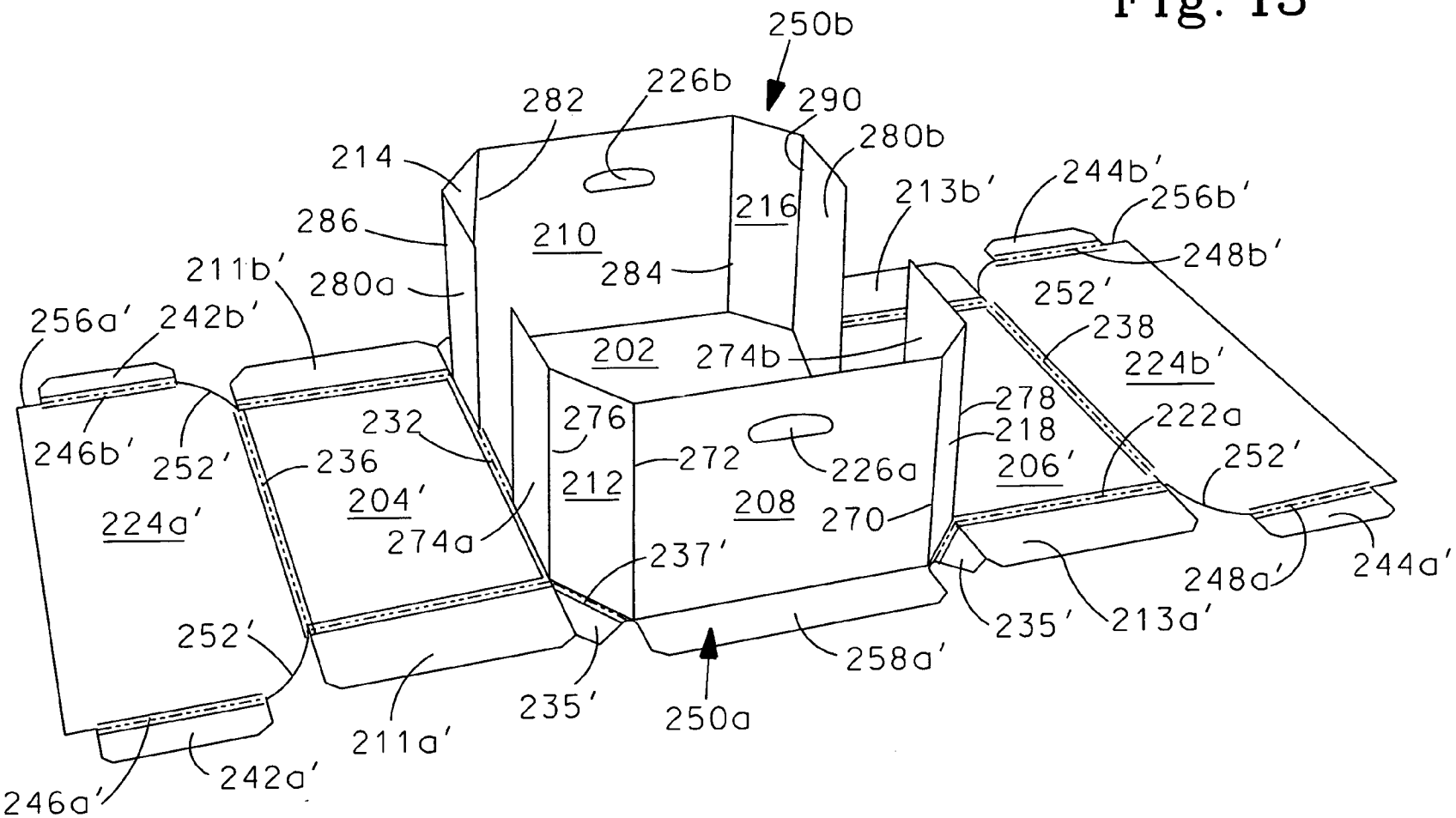
FIG. 13 is a top perspective view of the end walls located in their operative positions on the wrapper blank shown in FIG. 11 and illustrating the wrapper blank in the folding position around the end walls.

FIG. 13 is a top perspective view of the end pieces 250a, 250b located in their operative positions on the wrapper blank 230 shown in FIG. 11 and illustrating the wrapper blank 230 in the folding position around the end pieces 250a, 250b. The end pieces 250a, 250b are folded along their respective fold lines 270, 272, 282, and 284. The respective relatively narrow reinforcing corner panels 212', 214' and 216', 218' are folded inwardly toward the bottom panel 202' at proximately 45° degrees so that the respective corner flaps 235' glued to the respective reinforcing corner panels 212', 214' and 216', 218' to enhance the integrity of the container 200. Then, partial sidewall panels 274a', 274b', 280a', 280b' are folded with respect to fold lines 276, 278, 286, and 290 in a manner such that the bottom edges of the partial sidewall panels 274a', 274b', 280a', 280b' are respectively coincided with the fold line 232 and 234.

Figure 14:
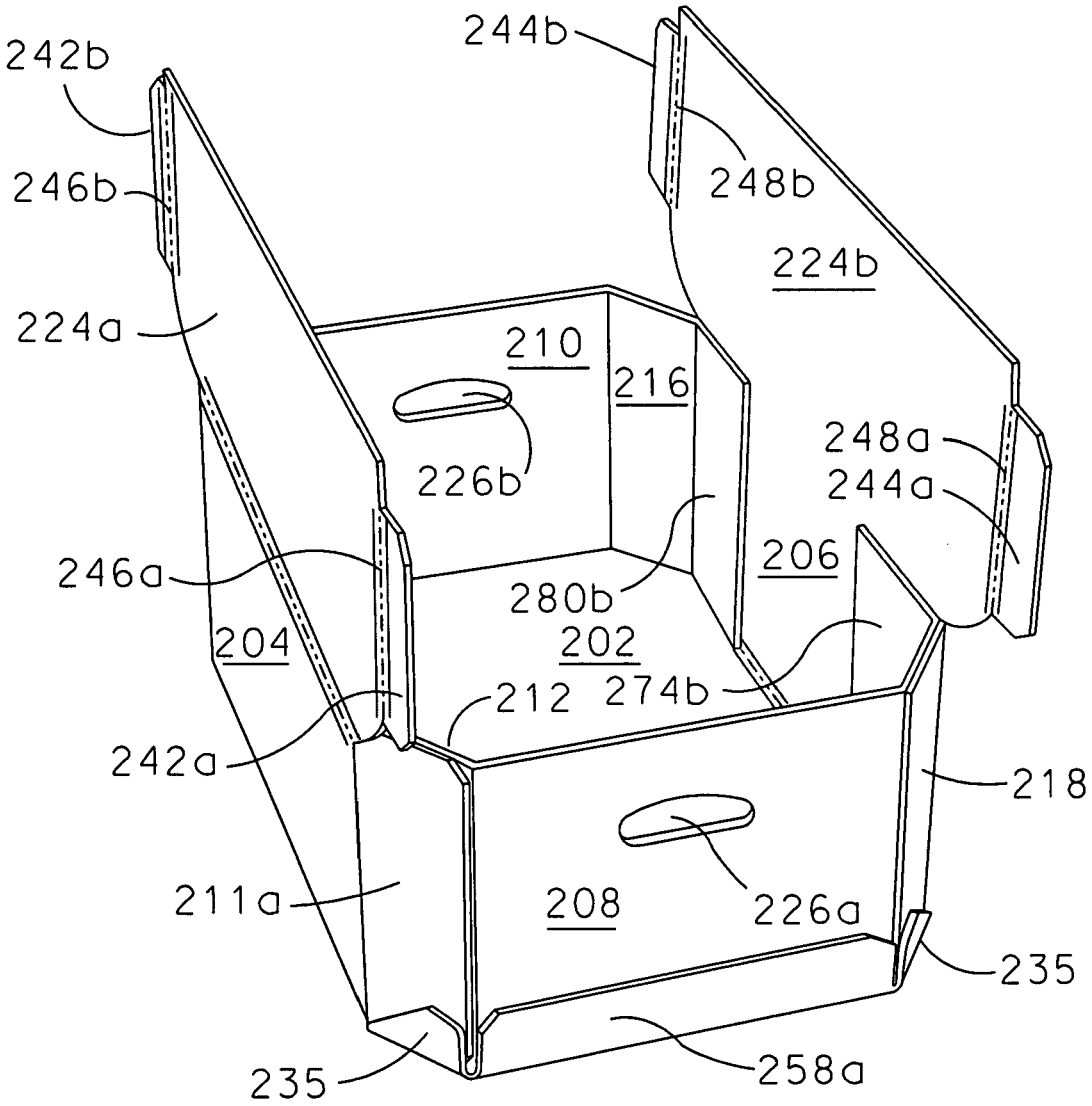
FIG. 14 is a perspective view of the fully constructed three-piece container depicted in FIG. 10 showing the wrapper blank folded and glued against the end walls to form the bottom wall and the side walls of the container.

FIG. 14 is a perspective view of the fully constructed three-piece container 200 depicted in FIG. 10 showing the wrapper blank 230 folded and glued against the end walls 208, 210 and partial side panels 274a', 274b', 280a', 280b' to form the bottom wall 202 and the side walls 204, 206 of the container 200. The respective side wall forming panels 204' and 206' are folded at 90 degrees with respect to the panel 202' along the fold lines 232, 234 and configured to be attached with the respective partial sidewall panels 274a', 274b', 280a', 280b' so that the respective side wall forming panels 204' and 206' and the respective partial sidewall 274a, 274b, 280a,

280*b* are glued to one another. Next, the respective top wall panels 224*a*', 224*b*' are folded along respective fold lines 236, 238 to form top wall 224*a*, 224*b* as depicted in FIG. 14. The respective flaps 242*a*, 242*b*, 244*a*, 244*b* are folded along the respective fold lines 246*a*, 246*b*, 248*a*, 248*b* and tucked inside the container 200. Then the flaps 258*a*, 258*b* are glued to the respective end walls 208, 210.

Figure 15:
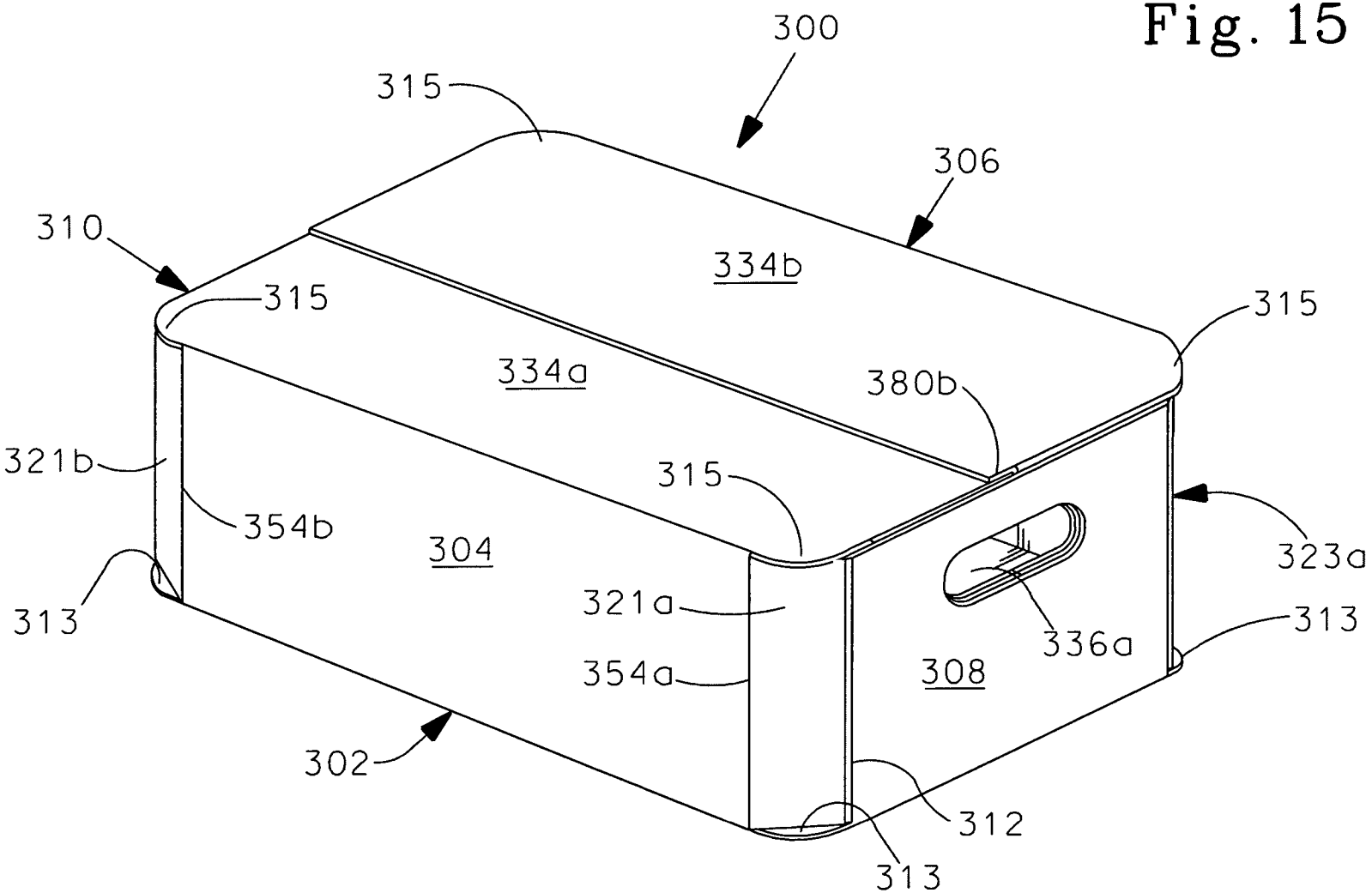
FIG. 15 is a top perspective view of a three piece container in accordance with a fourth embodiment of the invention.

FIG. 15 is a top perspective view of a container 300 in accordance with a fourth embodiment of the invention. The container 300 comprises a bottom wall 302, opposite parallel side walls 304, 306, opposite parallel end walls 308, 310 and diagonal corner panels 312, 314, 316 and 318 (FIG. 19) connecting the respective side walls 304, 306 and respective end walls 308, 310 at adjacent ends. The diagonal corner walls 312, 314, 316 and 318 extend at an angle generally 38 degrees with respect to the longitudinal axis of the container 300. Each of the side walls 304, 306 includes a respective pair of flaps 321*a*, 321*b* and 323*a*, 323*b* that are defined by respective fold lines 354*a*', 354*b*', 356*a*', 356*b*'. The opposite width of the respective side walls 304 and 306 is such that they project at their opposite side edges 321*a*, 321*b* over the diagonal corner walls 322, 324, 326 and 328, terminating at their edges proximately on the edge of the respective diagonal corner walls 322, 324, 326 and 328. Two top walls 334*a*, 334*b* are generally defined as top wall that encloses the container 300. The top wall 334*a* is integrally attached to the side wall 314 and the top wall 334*b* is integrally attached to the side wall 316, but one ordinary skill in the art would appreciate that it is within the scope of the present invention to use a single cover or top wall integrally attached to one of the side walls or end walls of the container. Alternatively, the top walls 334*a*, 334*b* may detachably cover the container 300. Two hand hole openings 336*a*, 336*b* are formed on the respective end walls 308, 310 to facilitate handling of the container 300.

Figure 16:
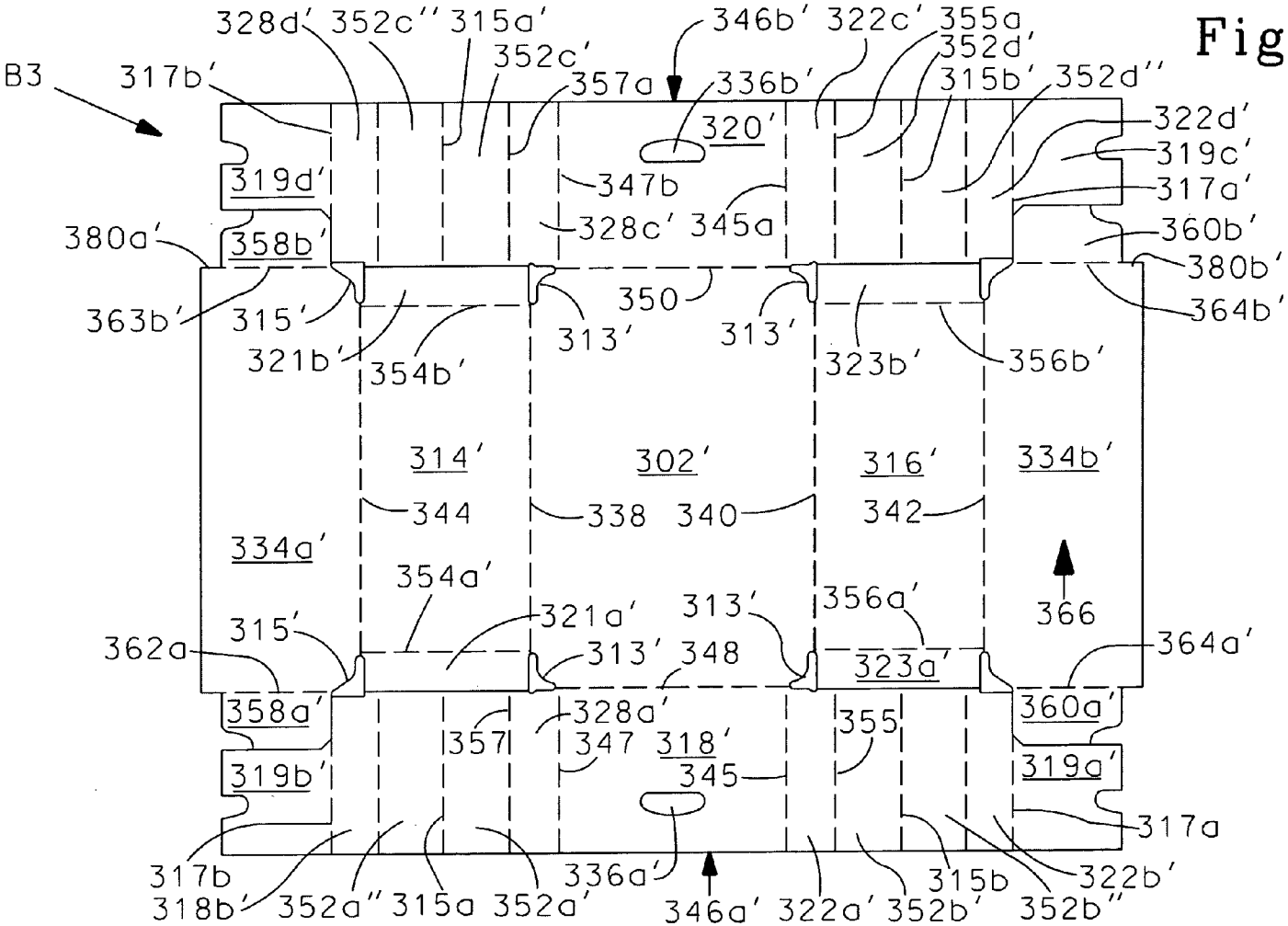
FIG. 16 is a plan view of a unitary blank B3 used to form the three piece container shown in FIG. 15 in accordance with a fourth embodiment of the invention.

FIG. 16 is a plan view of a unitary blank B3 used to form the container 300 shown in FIG. 15 in accordance with a fourth embodiment of the invention. The blank B3 comprises a centrally located rectangular panel 302' that forms the bottom wall 302. The rectangular panel 302' has an advantage of having four identical rounded corners 313' which enhances the integrity of the container 300 when the blank B3 is formed into container 300. Side wall forming panels 314' and 316' are foldably joined to opposite side edges of the bottom panel 302' by respective fold lines 338, 340. Each of the side wall panels 314', 316' includes two respective identical flaps 321*a*', 321*b*' and 323*a*', 323*b*' defined by respective fold lines 354*a*', 354*b*', and 356*a*', 356*b*'. Top wall panels 334*a*' and 334*b*' are foldably joined to respective longitudinal edges of the sidewall panels 314' and 316', opposite of their folded connection to the bottom panel 302', by fold lines 342, 344. Each of the top wall panels 334*a*', 334*b*' includes two respective identical flaps 358*a*', 358*b*' and 360*a*', 360*b*' defined by respective fold lines 362*a*', 362*b*', and 364*a*', 364*b*'. An Arrow mark 366 indicates the direction of corrugation of the blank B3. Similarly, each of the top wall panels 334*a*', 334*b*', as noted with respect to the rectangular panel 312', has an advantage of having two identical rounded corners 315' which enhances the integrity of the container 300 when the blank B3 is formed into container 300. In addition, it should be noted that flaps 358*a*', 358*b*' and 360*a*', 360*b*' do not extend the full width of the top wall panels 334*a*', 334*b*', but terminate short of the outer free edge thereof, defining projecting tabs 380*a*' and 380*b*'.

A pair of end pieces 346*a*, 346*b* is foldably joined to respective transverse edges of the panel 312' by fold lines 348, 350. The end pieces 346*a*, 346*b* are essentially identical to one another and they are mirror images of one another. The end piece 346*a* includes an end wall panel 318', four relatively narrow reinforcing corner panels 322*a*', 322*b*' and 328*a*', 328*b*' foldably joined to opposite ends of the panel 318' by fold lines 345, 347, and second partial sidewall panels 352*a*', 352*a*", 352*b*', 352*b*" are foldably joined to outer edges of the end wall panel 318' by fold lines 355 and 357. Respective end wall panels 319*a*', 319*b*' are foldably joined to the end wall panel 318' by fold lines 317*a* and 317*b*. Respective end panels 319*a*', 319*b*', respective reinforcing corner panel 322*b*', 328*a*', and reinforcing corner panels 322*b*', 328*b*' are folded along respective fold lines 315*a* and 315*b*. It should be noted that respective reinforcing corner panel 322*b*', 328*b*' fold 180 degrees onto respective reinforcing corner panel 322*a*', 328*a*' which ultimately provide double wall for the reinforcing corner wall 322, 328. Likewise, respective partial sidewall panels 352*a*", 352*b*" fold 180 degrees onto respective partial sidewall panels 352*a*', 352*b*' which ultimately provide double wall for the respective partial sidewall 352*a*, 352*b*. End panels 319*a*', 319*b*' fold onto the end wall panel 318' and thereby provide a stronger end wall 308 when the blank B3 is in the folded position. The substantially doubled end walls reinforces the hand hole openings 336*a*, 336*b* so that greater weight may be carried on by the container 300 without tearing the hand hole openings 336*a*, 336*b* during transportation.

The end piece 346*b* includes an end wall panel 320', four relatively narrow reinforcing corner panels 322*c*', 322*d*' and 328*c*', 328*d*' foldably joined to opposite ends of the panel 320' by fold lines 345*a*, 347*b*, and second partial sidewall panels 352*c*', 352*c*", 352*d*', 352*d*" are foldably joined to outer edges of the end wall panel 320' by fold lines 355*a* and 357*a*. Respective end panels 319*c*', 319*d*' are foldably joined to the end wall panel 320' by respective fold lines 317*a*', 317*b*'. Respective end panels 319*c*', 319*d*', respective reinforcing corner panel 322*c*', 322*d*', and reinforcing corner wall 328*c*', 328*d*' are folded along respective fold lines 315*c*' and 315*d*'. It should be noted that respective reinforcing corner panel 322*d*', 328*d*' fold onto respective reinforcing corner panel 322*c*', 322*d*' which provide double wall for the reinforcing corner wall 322, 328. Likewise, respective partial sidewall panels 352*a*", 352*b*" fold onto respective partial sidewall panels 352*a*', 352*b*' which provide double wall for the respective partial sidewall 352*a*, 352*b*. End panels 319*a*', 319*b*' fold onto the end wall panel 320' and thereby provide a stronger end wall 310 when the blank B3 is in the folded position.

Figure 17:
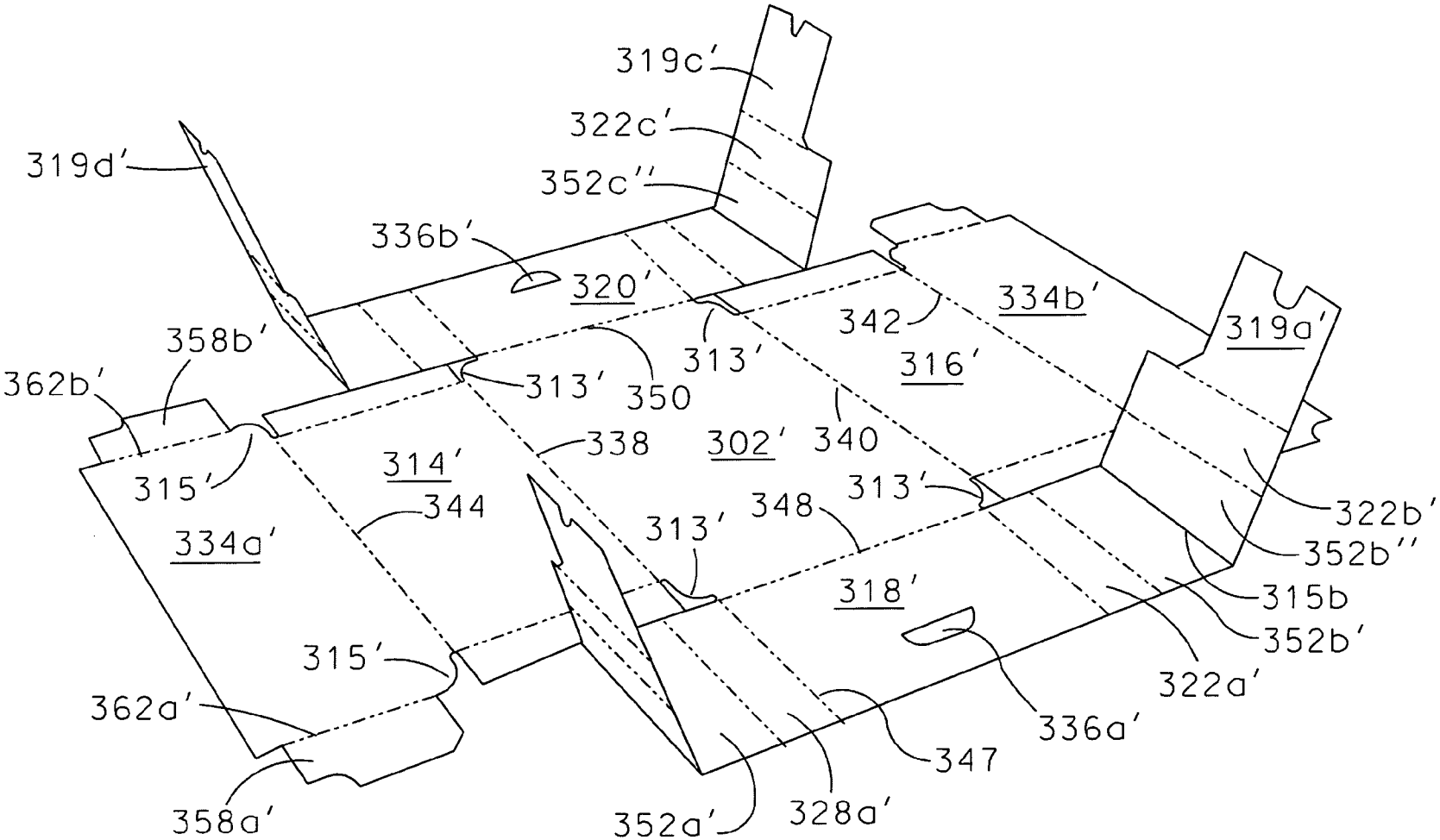
FIG. 17 is similar to FIG. 16 illustrating a portion of end pieces partially folded.
Figure 18:
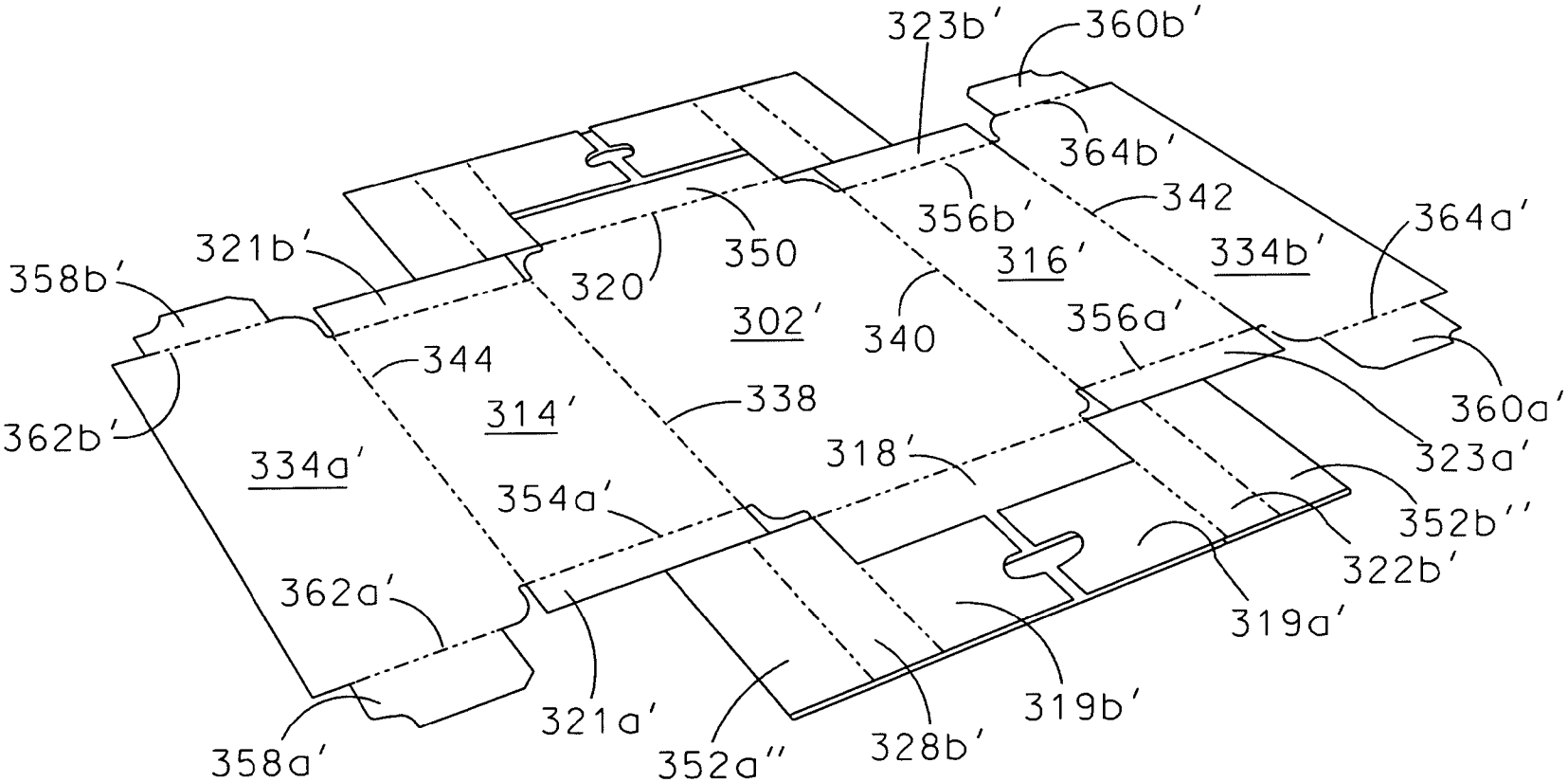
FIG. 18 is similar to FIG. 17 illustrating the end panels are folded onto the end wall panels.

Respective FIGS. 17, 18 are similar to FIG. 16, showing end panels 319*a*', 319*b*', 319*c*', 319*d*', reinforcing corner panels 322*b*', 322*c*', 328*b*', 328*c*' and partial sidewall panels 352*a*", 352*b*", 352*c*", 352*d*" in respective partially folded position and completely folded position with respect to their fold lines so that reinforcing corner panels 322*a*', 328*a*', 322*c*', 328*d*' and the partial sidewall panels 352*a*', 352*b*', 352*c*', 352*d*' are concealed by their respective identical panels as described hereinbefore.

Figure 19:
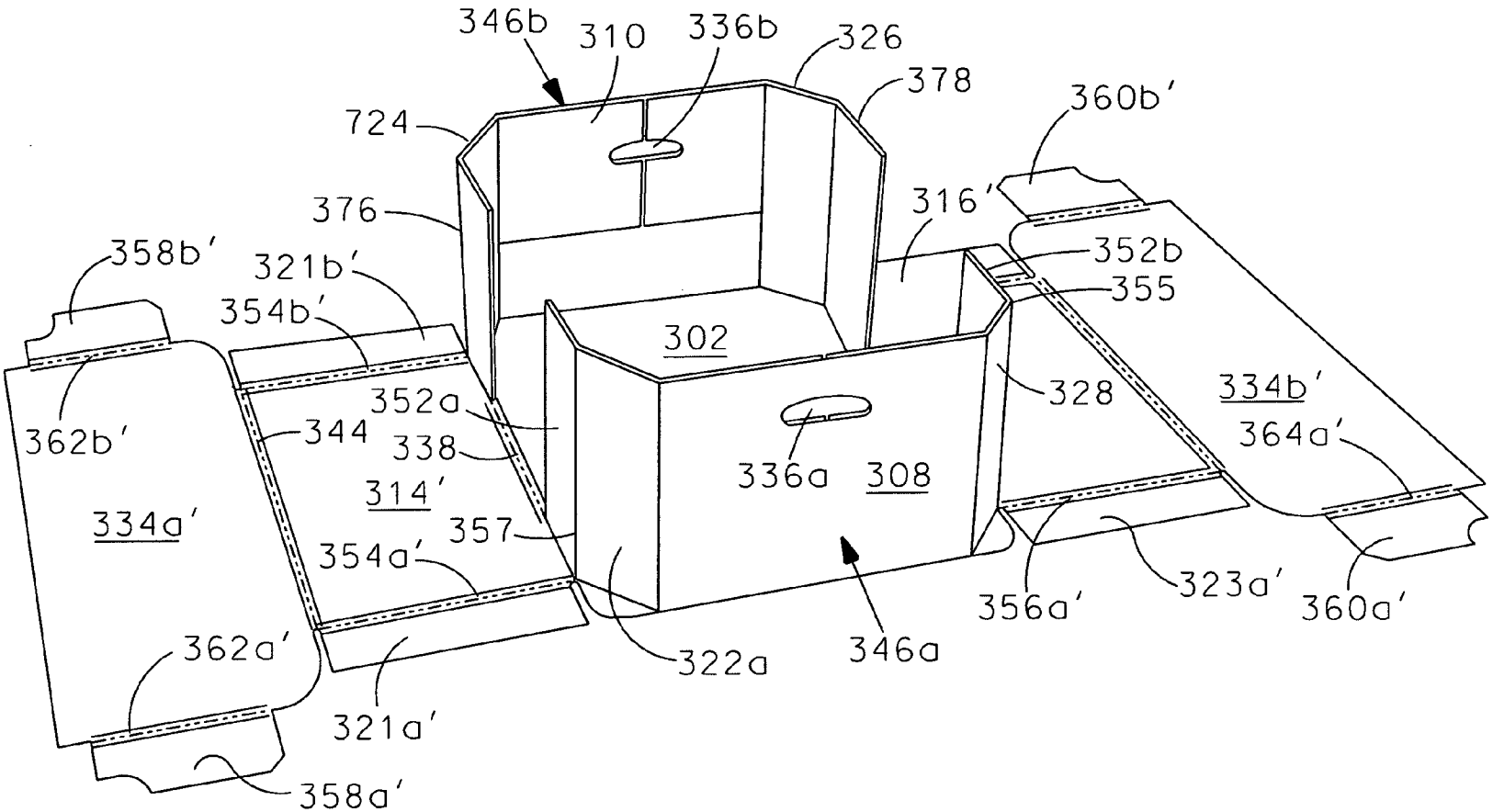
FIG. 19 is similar to FIG. 18, showing the unitary blank B3 in a partially folded position by illustrating a portion of the unitary blank B3 formed into the end walls of the three piece container depicted in FIG. 15.

FIG. 19 is similar to FIG. 17, showing the unitary blank B3 in a partially folded position by illustrating a portion of the unitary blank B3 formed into the end walls 308, 310 of the container 300 depicted in FIG. 15. Each of the end pieces 346*a*' and 346*b*' is folded 90° degrees with respect to their fold lines 348 and 350. Then, the respective relatively narrow reinforcing doubled corner panels 322, 324 and 326, 328 are folded inwardly toward the bottom panel 302' at angles from about 33 to about 38 degrees so that each of the rounded corners 313' provides a greater base by increasing surface area for the reinforcing corner panels 322', 324' and 326', 328' to transmit pressure applied at those location. Then, partial sidewall panels 352*a*', 352*b*', 354*a*', 354*b*' are folded with respect to fold lines 355, 357, 376, and 378 in a manner such that the bottom edges of the partial sidewall panels 352*a*', 352*b*', 354*a*', 354*b*' are respectively coincided with the fold line 338 and 340.

Figure 20:
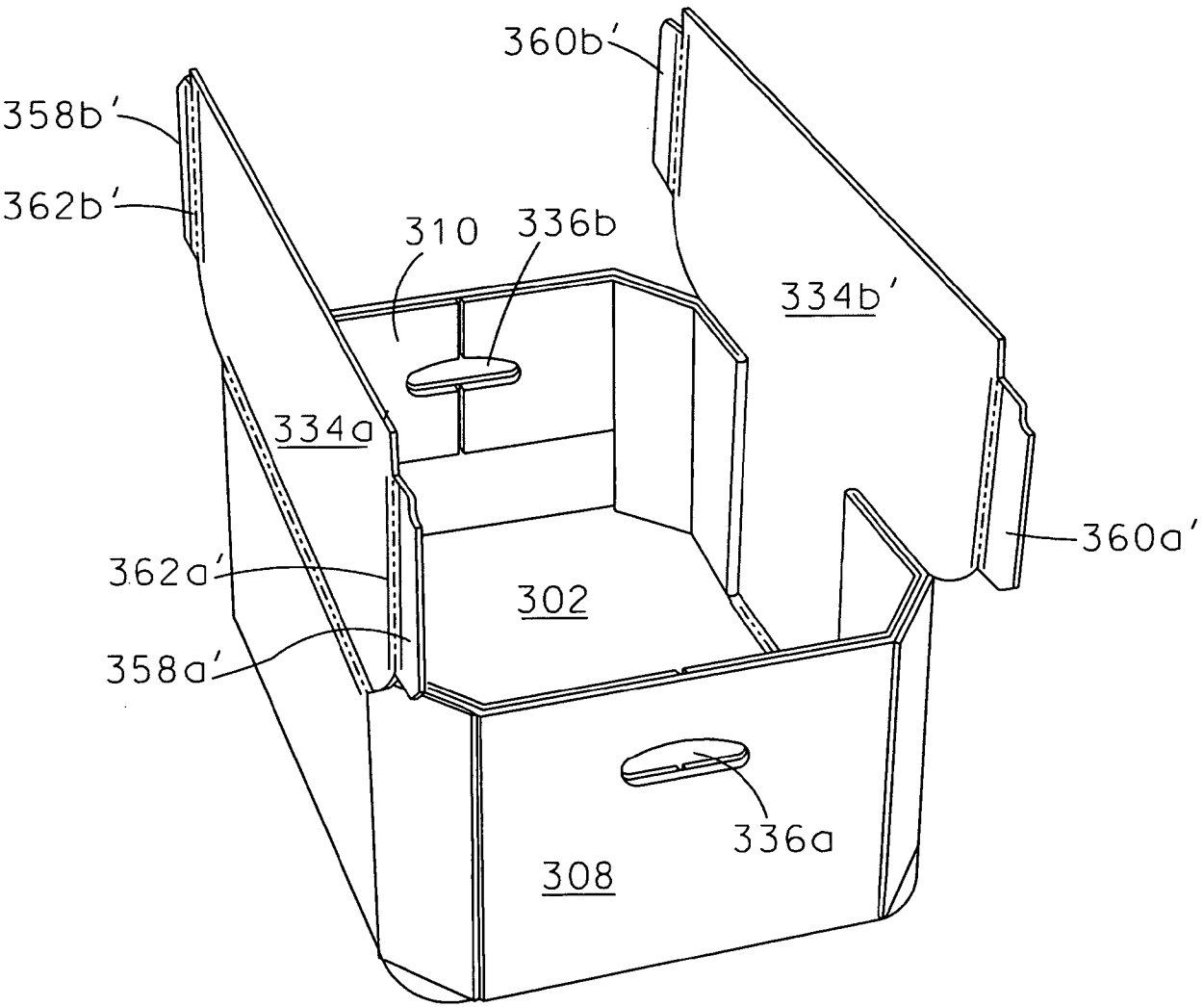
FIG. 20 is a perspective view of the fully constructed three-piece container formed from the blank B3 shown in FIG. 16 and illustrating the three-piece container in FIG. 15 in a partially opened position.

FIG. 20 is a perspective view of the fully constructed container 10 formed from the blank B3 shown in FIG. 16 and illustrating the container 300 in FIG. 15 in a partially opened position. The respective side wall forming panels 314' and 316' are folded at 90 degrees with respect to the panel 302' along the fold lines 338, 340 and configured to be attached with the respective partial sidewall panels 352*a*, 352*b* and 354*a*, 354*b* so that the respective side wall forming panels 314' and 316' and the respective partial sidewall 352*a*, 352*b* and 354*a*, 354*b* are glued to one another. Next, the respective top wall panels 334*a*', 334*b*' are folded along respective fold lines 342, 344 to form top wall 34*a*, 34*b* as depicted in FIG. 20. The respective flaps 358*a*, 358*b*, 360*a*, 360*b* are folded along the respective fold lines 362*a*, 362*b*', 364*a*', 364*b*' and tucked inside the container 300.

A container manufactured as above can be made with automated equipment, and when made and glued up as described, all seams and joints are sealed against the environment.

It should be noted that the angles of the reinforcing diagonal corner panel for all embodiments are from about 33 to about 38 degrees which helps to stiffen the structure of the container 10 or 70 or 200 or 300 to resist both outward and inward flexing of both the end walls and sidewalls of the container. Generally, a force against the end wall inwardly, tends to cause a somewhat equal reaction outwards on the sidewall of the container. Conversely, if the product inside the container pushes outwardly against the end wall, it tends to cause a somewhat equal reaction on the sidewalls and thereby force them to flex inwardly. This aspect is important for a couple of reasons: first, If the end wall flexes inward, it will cause the side walls to flex outward, as well as affecting positive sealing during the final closure of the side flaps. These flaps need to have a somewhat perpendicular and rigid surface to seal against as the machinery accomplishes the sealing which relies on a positive resistance from the end wall. Also, if the sidewall flexes outwardly, the intended distance between the top flaps edges will be affected causing less of an overlap, or more of a gap depending on the final sealing intention. Second, if the end wall flexes outwards, it will force the sidewalls to flex inward which will cause the top flaps to overlap more than they are intended to or have less of a gap depending on the final sealing intention. Additionally, the sealing of the side flaps will be difficult due to the end wall extending outward past a 90 degree position. Therefore, by modifying the diagonal corner panel angle ranges from about 33 to about 38 degrees, it tends to make the end walls and side walls react independently of one another when forces are applied thereto. In addition, because these reactions are now separated from each other, the flexing of the end panel is limited to the normal range that one would see in a traditional square cornered box making the final sealing of the side flaps easier.

While the invention has been described with reference to preferred embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A multi-sided container comprising a bottom wall, two top walls, opposite side walls, opposite end walls, a longitudinal axis and a plurality of diagonal corner walls, each of the top walls foldably joined to the respective opposite side walls and having two rounded corners, each of the top walls includes two flaps each of which extends from lateral edge thereof and being attached to the respective end walls, at least one of the plurality of diagonal corner walls defined by at least one diagonal corner panel and at least one reinforcement flap overlapping coextensively on one another such that the at least reinforcement flap overlaps to an outside surface of the at least diagonal corner panel and wherein a portion of the bottom wall projects under and beyond a bottom edge of the at least one diagonal corner wall and wherein each of the rounded corners of the respective top wall panels project over and beyond a top edge of the at least one diagonal corner wall.

2. The multi-sided container of claim 1 wherein the multi-sided container includes eight sides defining by two opposite side walls, two opposite end walls, and four diagonal corner walls.

3. The multi-sided container of claim 1 wherein the at least one of the plurality of diagonal corner walls includes four generally identical diagonal corner walls.

4. The multi-sided container of claim 1 wherein the at least one diagonal panel is oriented at an angle of from about 33 to about 38 degrees with respect to the longitudinal axis of the multi-sided container.

5. The multi-sided container of claim 1 wherein the bottom wall has four generally rounded corners that project under and beyond the bottom edge of each of four rounded corners.

6. The multi-sided container of claim 1 wherein the portion of the bottom wall is defined by one of the generally rounded corner thereof.

7. The multi-sided container of claim 1 wherein the at least one diagonal corner panel is integrally attached to the end wall.

8. The multi-sided container of claim 1 wherein the at least one reinforcement flap extends from at least one of the side walls.

9. The multi-sided container of claim 1 wherein each of the end walls are attached to the side walls via partial side wall panels.

10. The multi-sided container of claim 9 wherein the end wall panel, at least two diagonal corner panels, and the partial side wall panels are defined by at least one end piece wherein the end piece is integrally attached to the bottom wall.

11. The multi-sided container of claim 1 wherein the bottom wall, the side walls, and the top wall are integrally attached to one another to define a wrapper and the respective end walls, respective diagonal corner panels, and respective partial side wall panels are integrally attached to one another to define respective end pieces.

12. The multi-sided container of claim 1 further comprising a pair of hand hole openings wherein each opening formed into each of the opposite end walls.

13. A three separate pieces of blank for joining to one another for making a multi-sided container having a bottom wall, top walls, opposite side walls, opposite end walls, a longitudinal axis and a plurality of diagonal corner walls, the three separate pieces of blank comprising:

a wrapper piece of blank having a bottom panel and two side wall panels longitudinally attached to the bottom panel, each of the side wall panel includes two reinforcement flaps wherein each of the reinforcement flaps extends from lateral edges of each side wall panel and each of the top walls extends from longitudinal edges of each side wall panel and wherein each of the top walls includes two flaps each of which extends from lateral edge thereof; and a pair of end piece blanks configured to be transversely attached to the wrapper blank to form a multi-sided container wherein when the multi-sided container constructed, a portion of the bottom wall projects under and beyond a bottom edge of the at least one diagonal corner wall, each of the end pieces includes at least two diagonal corner panels and two partial side walls extend from the lateral edges of each end pieces when they are in folded position and wherein each of the end pieces being formed into a doubled or a tripled wall when folded.

* * * * *